US005576812A

United States Patent [19]

Hibino et al.

[11] Patent Number: 5,576,812

[45] Date of Patent: Nov. 19, 1996

[54] DEVELOPING METHOD WITH CARRIER CHAINS CONTACTED TO IMAGE BEARING MEMBER

[75] Inventors: Masaru Hibino, Kawasaki; Yukio Nagase, Tokyo; Kenichiro Waki, Kawasaki; Hiroyuki Suzuki, Yokohama, all of Japan

[73] Assignee: Canon Kabushiki Kaisha, Tokyo, Japan

[21] Appl. No.: 314,303

[22] Filed: Sep. 30, 1994

[30] Foreign Application Priority Data

Oct. 1, 1993 [JP] Japan ..... 5-270000

[51] Int. Cl.[6] ..... G03G 15/09

[52] U.S. Cl. ..... 355/251; 118/656; 118/657; 118/658

[58] Field of Search ..... 355/251, 253; 118/656–658

[56] References Cited

U.S. PATENT DOCUMENTS

| | | | |
|---|---|---|---|
| 4,357,103 | 11/1982 | Kroll | 118/658 X |
| 4,531,832 | 7/1985 | Kroll et al. | 118/657 X |
| 4,679,527 | 7/1987 | Chang | 118/658 |
| 4,862,828 | 9/1989 | Kumasaka et al. | 118/658 |
| 4,941,019 | 7/1990 | Honda et al. | 355/251 |
| 5,051,782 | 9/1991 | Yamaji | 355/251 |
| 5,070,812 | 12/1991 | Yamaji | 118/658 |
| 5,078,087 | 1/1992 | Hogestyn | 118/657 |
| 5,129,357 | 7/1992 | Yamaji | 118/658 |
| 5,202,730 | 4/1993 | Fuji et al. | 355/251 |
| 5,270,484 | 12/1993 | Tsuchiva et al. | 118/653 |
| 5,296,328 | 3/1994 | Fuji et al. | 118/657 X |
| 5,402,215 | 3/1995 | Yamaji | 355/251 |

*Primary Examiner*—Matthew S. Smith

*Attorney, Agent, or Firm*—Fitzpatrick, Cella, Harper & Scinto

[57] ABSTRACT

A developing method includes forming a magnetic field between an image bearing member bearing an electrostatic image and a developer carrying member carrying a developer comprising toner particles and carrier particles; and contacting chains of carrier particles formed on the developer carrying member to the image bearing member; wherein an absolute value of an intensity of a magnetic field in a movement direction of the developer carrying member over the entire portion of the developer carrying member at a position where the carrier is contacted to the image bearing member is positive.

8 Claims, 15 Drawing Sheets

DEVELOPING METHOD WITH CARRIER CHAINS CONTACTED TO IMAGE BEARING MEMBER

FIELD OF THE INVENTION AND RELATED ART

The present invention relates to a developing method and apparatus for developing an electrostatic image formed on an image bearing member through electrophotographic process or electrostatic recording process.

Heretofore, various two component developers have been used for developing a latent image formed on an image bearing member such as an electrophotographic photosensitive member. Particularly, a two component developer comprising non-magnetic toner and magnetic carrier particles permits compact and effective development by the use of a magnetic brush developing method or the like. As for a magnetic development, one component developer using magnetic toner is used, but the one component developer contains magnetic material which is black, and therefore, it is difficult to obtain desired colors. For this reason, for the formation of a color image, a system using two component developer is more advantageous.

Referring to FIG. 22, an example of a developing apparatus using a two component developer will be described. A latent image formed on an image bearing member in the form of a photosensitive drum 103 is faced to a developing device 101. In the developer container 136 of the developing device 101, a developer D is contained. The developer D is carried on the developing sleeve 122 by the magnetic force of a stationary magnet 123 in the developing sleeve 122 made of non-magnetic material. The developer D is applied on the surface of the developing sleeve 12 by a regulating blade 124 and a carrier returning portion 126 by rotation of the developing sleeve 122. It is then carried to a developing zone where it is faced to the photosensitive drum 103. The developer D comprises non-magnetic toner having a particle size of 8 and magnetic carrier particles having a particle size of 50 μm. In the developing zone, the particles are erected as chains by the magnetic force of the stationary magnet 123. The latent image on the photosensitive drum 103 is developed with toner by an AC bias applied to the developing sleeve 122 from an unshown voltage source. The developer having passed through the developing zone is taken into a developer container 136, again, and is stirred by the screw 161.

By the magnetic brush developing method using the two component developer described above, the developer can be sufficiently contributed to the developing action, and therefore, high density image can be provided. However, at the position corresponding to the developing pole, the chains of the magnetic brush are sparse, and therefore, the image is relatively rough for high-light and halftone zones.

As for the method for reducing the roughness in the high-light and halftone density region, a two component developer developing method in which the magnetic brush density in the developing zone is high, would be considered. As for a method of providing a high density final image in all of the density region, the particle size of the magnetic carrier may be reduced to increase T/(T+C), which also is increased in a two component developing system (by reducing the particle size, the magnetic brush density tends to increase).

A most effective method for providing high density chains, as is known, is to reduce the magnetization per unit volume of the magnetic carrier (emu/cm$^3$) in a magnetic field at a position corresponding to the magnetic pole. However, in this case, the force effective to confine the magnetic carrier on the developer carrying means is reduced with the result of the carrier easily being transferred onto the image bearing member. When the particle size of the carrier is reduced, the magnetization per one carrier particle (emu/one carrier particle) reduces with the result of easier transfer of the carrier to the image bearing member. When the density of the chain is increased, the toner adjacent the bottom portion of the magnetic brushes become unable to contribute to the developing action with the result of reduced image density.

SUMMARY OF THE INVENTION

It is a principal object of the present invention to provide a developing method and apparatus in which the image roughness in the high-light and halftone density region by reducing magnetization per unit volume of the carrier.

It is another object of the present invention to provide a developing method and apparatus in which deposition of the carrier to an image bearing member is prevented.

According to an aspect of the present invention, there is provided a developing method, comprising: forming a magnetic field between an image bearing member bearing an electrostatic image and a developer carrying member for carrying a developer comprising toner and carrier particles; contacting chains of carrier particles to the image bearing member; and wherein an absolute value of an intensity of a magnetic field in a movement direction of the developer carrying member at a position where the carrier is contacted to the image bearing member is positive.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to FIGS. 1–16, an image forming apparatus according to a first embodiment of the present invention will be described.

Figure 2:
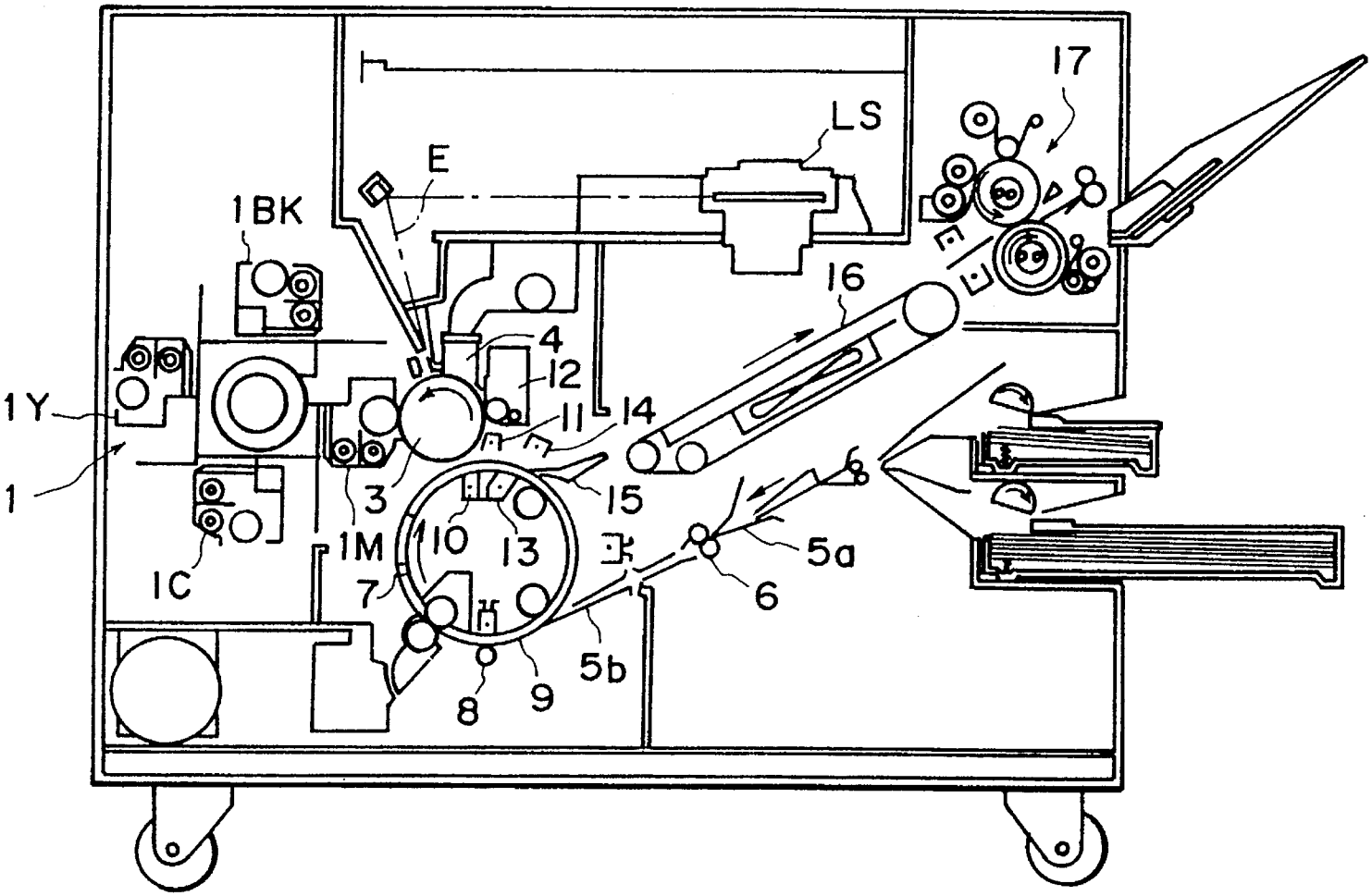
FIG. 2 is a general arrangement of an image forming apparatus according to the first embodiment.

FIG. 2 shows a color printer of an electrophotographic type using a developing method according to the present invention. The printer comprises a photosensitive drum 3 as the image bearing member, which rotates in a direction of an arrow. Around the photosensitive drum 3, there are provided a charger 4, a rotary type developing apparatus 1 having developing devices 1M, 1C, 1Y and 1BK, a transfer discharger 10, a cleaning means 12 and a laser beam scanner LS disposed above the photosensitive drum 3.

The general sequential operations of the color printer will be described briefly in the case of a full-color mode as an example. The photosensitive drum 3 is uniformly charged by a charger 4. Then, a latent image is formed on a photosensitive drum 3 by a laser beta E modulated in accordance with a magenta image signal from an original (not shown), and thereafter, the latent image is developed by the magenta developing device 1M placed at the developing position, beforehand.

A transfer material is fed by way of a sheet feeding guide 5*a*, a sheet feeding roller 6 and a sheet feeding guide 5*b*. The transfer material is gripped by a gripper 7 in synchronism with a predetermined timing, and is electrostatically wrapped around the photosensitive drum 9 by a roller 8 and an opposite electrode. The transfer drum 9 is rotated in a direction indicated by an arrow in synchronism with the photosensitive drum 3. The developed image developed by the magenta developing device 1M is transferred onto a transfer material by a transfer charger 10 at the transfer station. The transfer drum 9 continues to rotate to be prepared for the next color transfer (cyan in the case of FIG. 2).

On the other hand, the photosensitive drum 3 is electrically discharged by a discharger 11, and is cleaned by cleaning means 12. It is charged again by the charger 4, and it is exposed to the next cyan image signal. By this time, the developing device 1 rotates so that the cyan developing device 1C is placed at a predetermined developing position, so that the cyan developing action is carried out.

Subsequently, the above-described steps are repeated for yellow and black toners. When the transfers of four colors are completed, the four color images on the transfer material is electrically discharged by dischargers 13 and 14, and the gripper 7 is released. It is separated from the transfer drum 9 by a separation claw 15. The transfer material is fed to an image fixing device (heat-pressure roller fixing device) 17 on a conveying belt 16. Thus, a series of sequential operations for full-color printing is completed, and a full-color print is produced.

Figure 3:
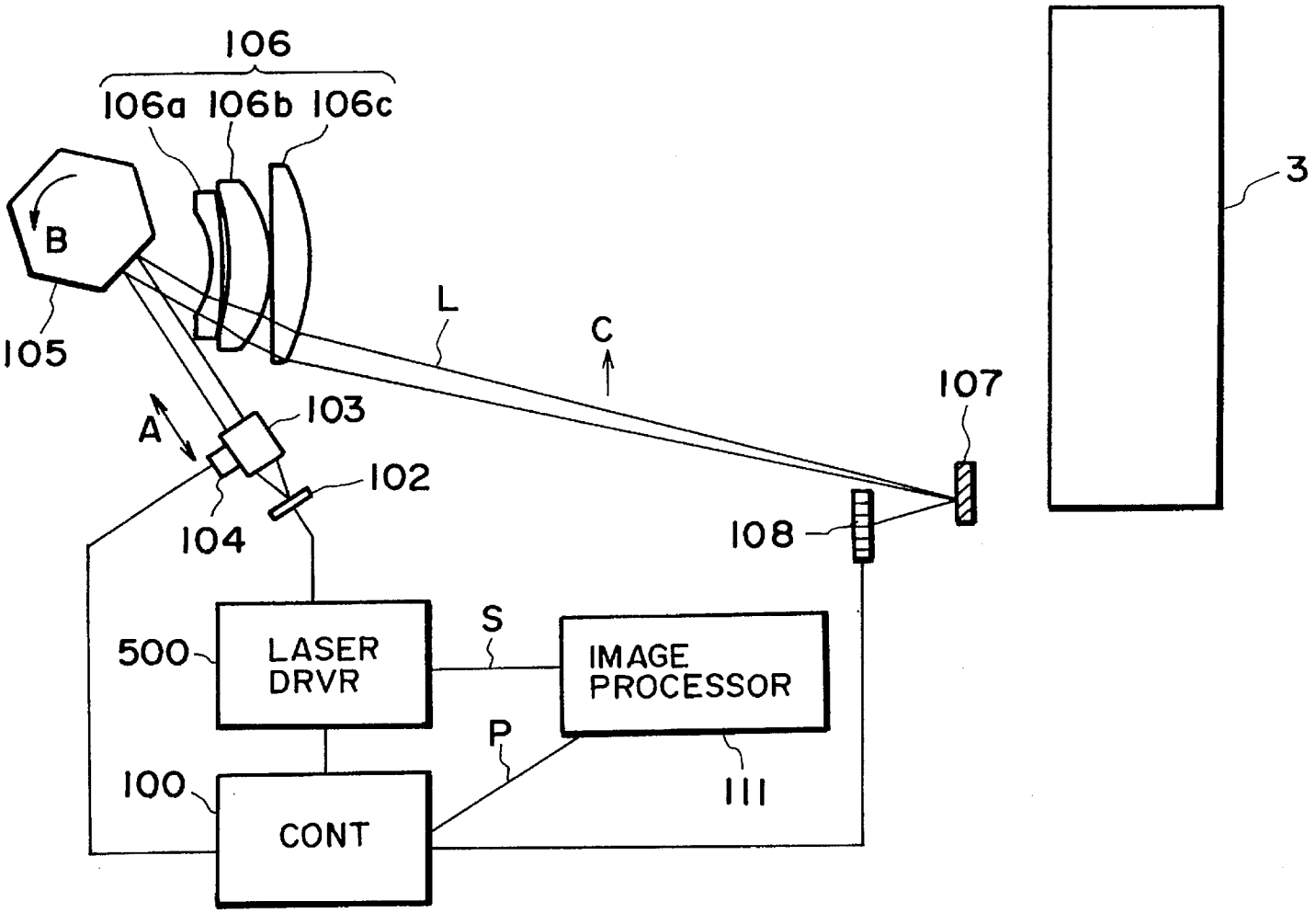
FIG. 3 illustrates in detail a scanning optical system used in the apparatus of FIG. 2.

A laser beam scanner LS constituting exposure means, as shown in FIG. 3, comprises a semiconductor laser 102, a high speed rotation polygonal mirror 105, and an f-θ lens 106. The semiconductor laser 102 receives time series digital image signals produced and outputted by a computer in an image reading apparatus, and oscillates a laser beam PWM-modulated in accordance with the signal, to which the photosensitive drum 3 is exposed.

Referring to FIG. 3, a more detailed explanation will be made. A solid state laser element 102 as a laser source is connected with a laser driver 500 which an emitting signal generator for supplying emitting signals for emitting the laser beam. The laser is rendered on and off in accordance with the emitting signals from the laser driver. The laser beam emitted from the solid state laser element 102 is collimated to a parallel beam by collimator lens system 103. The collimator lens system 103 is movable through a predetermined distance in a direction of an arrow A along the optical path of the laser beam by focus adjusting means 104, which will be described hereinafter.

The polygonal mirror 105 rotates at a constant rotational speed in a direction B, and reflects the parallel beam emitted from the collimator lens 103 to scan the photosensitive member in a predetermined direction C. An f-θ lens group 106 (106*a*, 106*b*, 106*c*) disposed in front of the rotatable polygonal mirror 105 is effective to image the beam deflected by the polygonal mirror 105 at a predetermined position on the surface to be scanned, that is, the surface of the photosensitive drum 3 with a uniform scanning speed on the surface to be scanned.

The laser beam L is introduced onto CCD (solid state image pickup element) 108 as detecting means through reflection mirror 107, and scans the photosensitive drum 3 (the surface to be scanned). The CCD 108 comprises a plurality of light detecting elements arranged in a direction C at positions substantially optically equivalent to the surface of the photosensitive drum 3. The CCD 108 is connected to a controller 100 for controlling focus adjusting means 104 and a laser driver.

An image processor 111 is connected to the laser driver 500 and the controller 100.

With the structure described above, when a predetermined image is formed, an image output signal P is supplied to the controller 100 from the image processor 111, and an image signal S is supplied to the laser driver 500, and the solid state laser element 102 is actuated at predetermined timing.

The laser beam emitted from the solid state laser element 102 is converted to a parallel beam by a collimator lens 103 and is deflected in a direction C by the polygonal mirror 105 rotating in the direction B, and is imaged as a spot on the photosensitive drum by the f-8 lens group 106. By the scanning of the laser beam L, an exposure distribution on one scanning line is formed on the surface of the photosensitive drum 3 surface. In addition, the photosensitive drum 3 is rotated through a predetermined angle for each scan to provide a latent image having an exposure distribution in accordance with the image signal S on the drum 3, so that a visualized image is formed on the transfer material by a known electrophotographic process.

The image output signal P is produced by the image processor 111 prior to the image signal S, and it is completed after the completion of the output of the image signal S. The controller 100 is at rest when the image output signals P are supplied from the image processor 111. Therefore, during the image forming operation, the size and contrast of the pixel can be maintained constant A description now will be made as to the operation of the focus adjusting means 104 of the laser beam L.

Figure 4B:
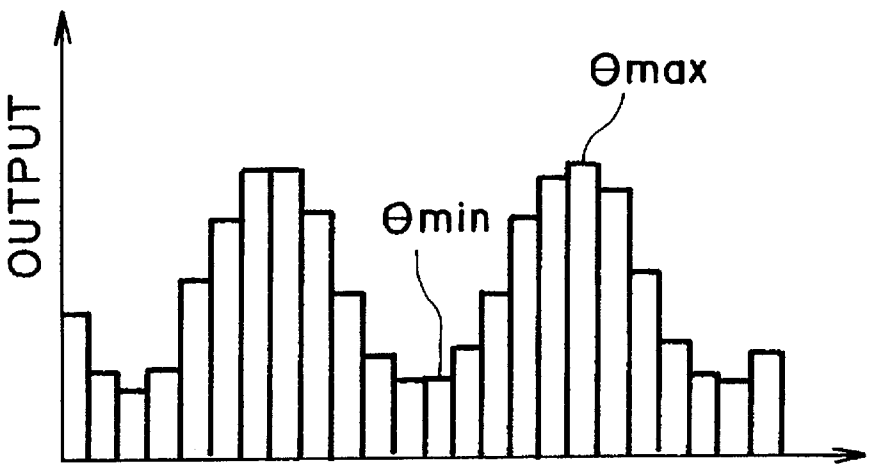
FIGS. 4(*a*) and 4(*b*) are a graph of on/off of a laser source, and an output distribution of each pixel of CCD, respectively.
Figure 4A:
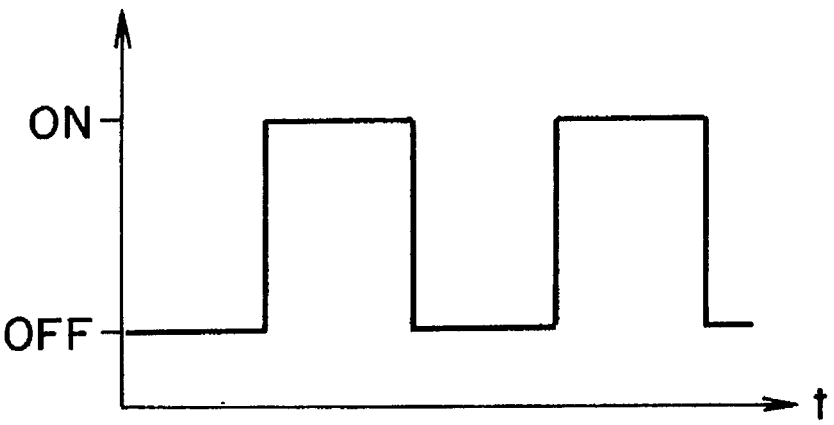

A operation signal is supplied to a laser driver 500 from the controller 100, and the laser driver 500 produces a rectangular wave rendered on and off at regular intervals as shown in FIG. 4(*a*) for a predetermined period, and the solid state laser element 102 is actuated in accordance with the signal. The laser beam produced by the solid state laser element 102 is deflected as described above, and is reflected by reflection mirror 107 and scans the CCD 108 located at a position optically equivalent to the photosensitive drum 3.

Before the laser beam L scans the CCD 108, the controller 100 reset the accumulated charge for the image in CCD 108, and the charge is accumulated for each pixel of the CCD 108 by the spot scan on one line and thereafter, the charge is read out as an electric signal.

When one scanning action occurs by the laser beam which is on and off from the solid state laser element 102, the exposure distribution on the CCD 108 surface results in a distribution corresponding to a spot diameter of the laser beam L, because the CCD 108 is at a position optically equivalent to the photosensitive drum 3. Accordingly, an output of each pixel of CCD 108 becomes as shown in FIG. 4(*b*). The signal is transmitted to the controller. In the controller 100, a contrast V is calculated and measured by the following equation:

$$V=(\theta max-\theta min)/(\theta max+\theta min) \quad (1)$$

where θmax is the maximum of the output of the CCD 108, and θmin is the minimum thereof.

In this case, the contrast V increases with a decrease in the spot diameter in the scanning direction, and therefore, if the contrast V is not equal to a predetermined contrast V0 as a result of comparison between a predetermined contrast V0 and the contrast V calculated by equation (1), a driving signal is supplied to the focus adjusting means 104 from the controller 100 so as to move the collimator system 103 in a direction A through a predetermined distance. With the collimator lens system 103 thus moved, the contrast V is measured, and the collimator lens system 103 is fixed at a position where the measured contrast is equal to the predetermined V0. By doing so, the focus deviation of the optical system V0 is corrected to minimize the scanning spot diameter of the laser beam L.

Figure 5:
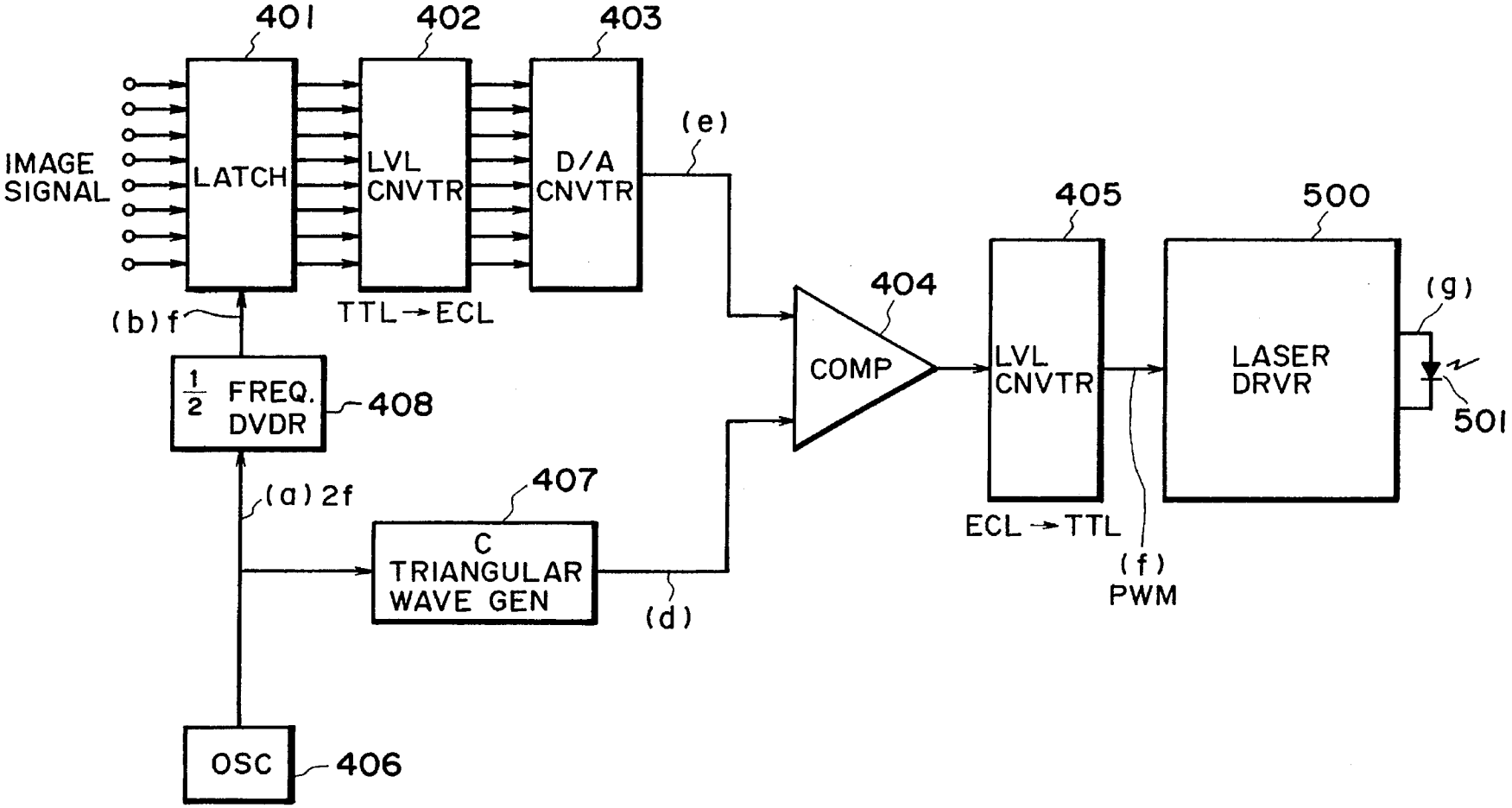
FIG. 5 is a circuit diagram of a PWM circuit used in the apparatus of FIG. 2.
Figure 6:
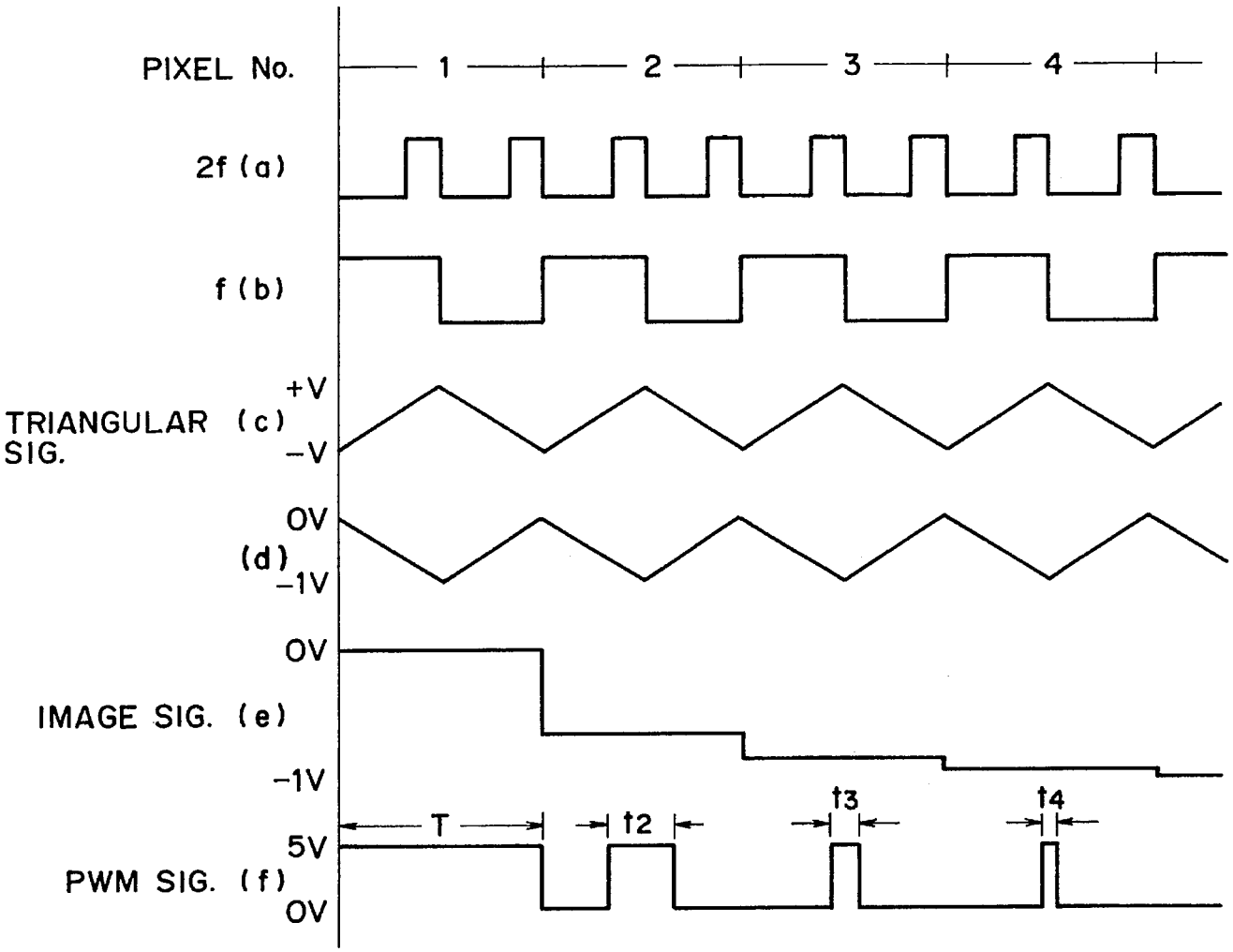
FIG. 6 is a timing chart illustrating an operation of the circuit of FIG. 5.

FIG. 5 is a block diagram of an example of a pulse width modulation circuit, and FIG. 6 is a timing chart of an operation of the pulse width modulating circuit. In FIG. 5, reference numeral 401 designates a TTL latching circuit for latching an 8 bit digital image signal; 402, is a level converter for converting the TTL logic level to a high speed ECL logic level; 403 is a D/A converter for converting the ECL logic level to an analog signal. Reference numeral 404 is an ECL comparator for generating a PWM (pulse width modulation) signal; 405, is a level converter for converting ECL logic level to TTL logic level; 406 is a clock oscillator for generating oscillating clock signals **2*f*; 407 is a triangular wave generator for generating substantially ideal triangular signals in synchronism with the clock signal 2*f*; 408 is a ½ frequency divider for dividing the clock signal 2*f* to produce image clock signals f. Thus, the clock signal 2*f*** has a period which is twice the period of the image clock signal f. In order to effect high speed operation of the circuit, ECL logic circuit is arranged at proper positions.

Referring to FIG. 6, which is a timing chart, the operation of such a circuit will be described. Signal a designates a clock signal **2*f*, and signal b designates an image clock signal f. As shown in the FIG. 6, these signals are interrelated with the image signal. Also in the triangular wave generator 407, in order to maintain the duty ratio of 50% of the triangular wave signal, the clock signal 2*f*** is once ½-frequency-divided, and then, the triangular wave signal c is generated. The triangular wave signal c is converted to ECL level (0 to −1 V) into a triangular wave signal d.

On the other hand, the image signal has 256 tone levels from 00h (white)-FFh (black), for example. Here, "h" designates hexadecimal number. The image signal e designates ECL voltage level as a result of D/A conversion for several image signal levels. For example, the first pixel has a maximum density pixel level FFh; the second pixel has an intermediate tone level 80h; the third pixel has an intermediate tone level 40h; the fourth pixel has an intermediate tone level 20h. The comparator 404 compares the triangular wave signal d and the image signal e, and the PWM signals such as pulse width (time period) T, t2, t3, t4 or the like in accordance with the pixel density to be printed. The pulse width decreases with a decrease in the image density of the pixel. The PWM signal is converted to a TTL level of 0 V or 5 V into a PWM signal f, which is supplied to a laser driver circuit 500.

In the circuit of FIG. 5, at the front portion of the latching circuit 401, there is provided an unshown look-up table, which is a memory storing the data of γ-correction of the image data. The memory is accessed with address data of an 8 bit image signal for one pixel, and an image signal of a datum with desired γ-correction is produced. Normally, one particular γ-correction table can be used in one screen for one pixel. In other words, for each line scan of the beam, three tables, for example, are sequentially and repeatedly used, so that the γ-correction is changed for each line, that is, in a sub-scan direction, to permit tone correction in that direction.

For the case of a low toner density, a steep γ-table is used to avoid the influence of inherent densities of the yellow, magenta, cyan and black colors, for example. For a high density case an opposite property γ-table is used. In front of the look up table, a non-linear masking circuit is provided for correcting turbidities of the toners, for example a secondary masking circuit.

Using the above-described PWM system halftone can be properly reproduced without reducing the pixel density by the area tone reproduction for each pixel dot.

Figure 7:
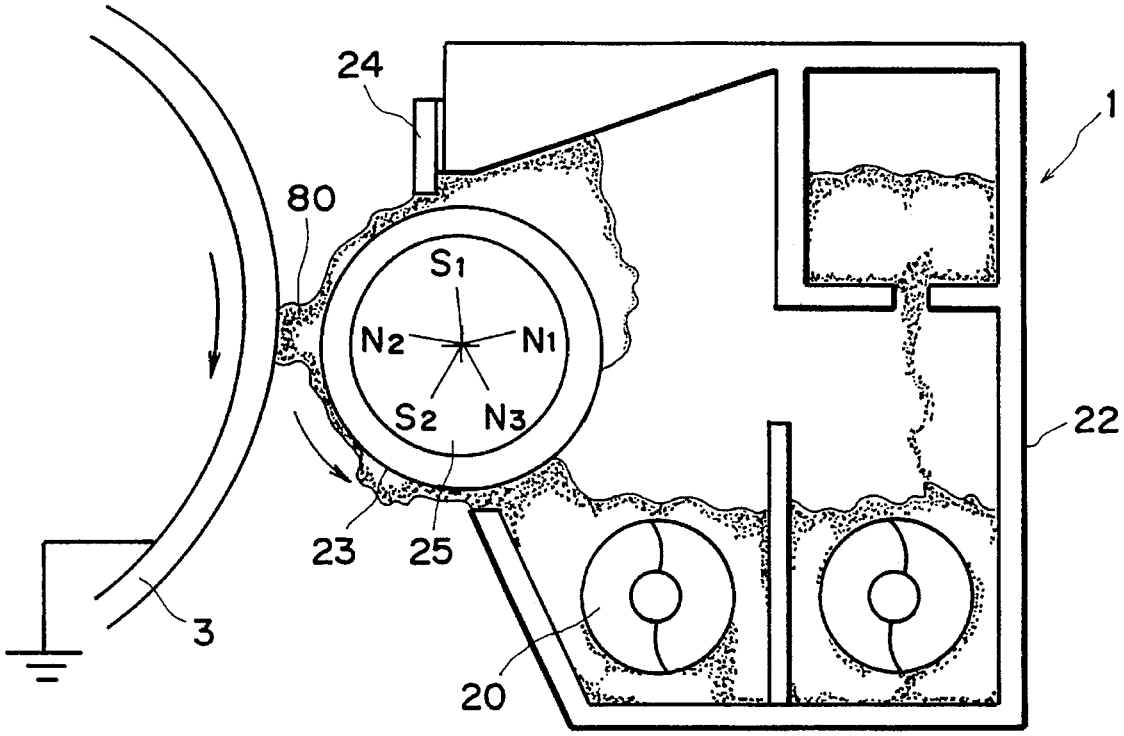
FIG. 7 illustrates a structure of a developing apparatus of FIG. 2.

FIG. 7 is a back side view of the apparatus of FIG. 2 and, more particularly, it is an enlarged view of# one of the developing devices of the rotary developing apparatus 1 usable with the laser beam printer shown in FIG. 2, and the developing device is disposed at the developing position opposed to the photosensitive drum 1.

The developing device 1 functions to develop the latent image formed on a latent image bearing member 3 such as a photosensitive member or the electric member through an electrophotographic method or electrostatic recording method. It comprises a developer container 22, a developing sleeve 23 as a developer carrying means, a blade 24 as a developer layer regulating member. The developer container 22 is provided with an opening adjacent to the latent image bearing member, and a developing sleeve 23 is rotatably mounted in the opening. Above the developing sleeve 23, a blade 24 is provided with a predetermined gap there between.

The developing sleeve 23 comprises a non-magnetic material and rotates in the direction indicated by an arrow during the developing operation. In the developing sleeve 23, a magnetic field generating means in tile form of a magnet 25 is fixed. The magnet 25 forms a magnetic field adjacent the developing position where the developer is supplied to the photosensitive drum 23 from the developing sleeve, and therefor, forms a magnetic brush, by the developing magnetic pole N2. In addition to the magnetic pole N2, magnet 25 comprises magnetic poles S1, S2, N1 and N3 for feeding the developer 80.

The blade 24 is made of aluminum (Al), SUS 316 or another non-magnetic material. This is disposed with a predetermined gap relative to the surface of the developing sleeve 23. The gap is effective to control the amount of developer supplied to the developing zone on the developing sleeve 23 and, more particularly, the thickness of the layer of the developer 80 on the developing sleeve 23. Accordingly, in this embodiment, developer comprising non-magnetic toner and hard ferromagnetic particles, is passed through the gap between the end of the blade 24 and the surface of the developing sleeve 23 toward the developing zone.

The thickness of the layer of the developer 80 regulated by the blade 24 is such that the layer is brought into contact with the photosensitive drum 2 at the developing position. The developer 80 is a two-component developer comprising non-magnetic toner and soft ferromagnetic particles (carrier). The developer 80 is supplied into the developing zone (N2). It is fed toward S2 while being carried on the developing sleeve 2. When the developer is conveyed to the N3 pole, developer stagnating adjacent the pole N3 by the repelling magnetic field provided by the magnetic poles N3 and N1, is scraped off by an unshown developer scraping means to the stirring and feeding screws 20. After the developer is sufficiently stirred into a uniform state, it is conveyed to the neighborhood of the developing sleeve 23 again by an unshown developer supply means, and is magnetically attracted to the magnetic pole N2 of the magnet 25.

A description now will be made as to the developer used in this embodiment. A developer 80 suitable for use in this embodiment is a two-component developer comprising non-magnetic toner and soft ferromagnetic particles (carrier)

Figure 8:
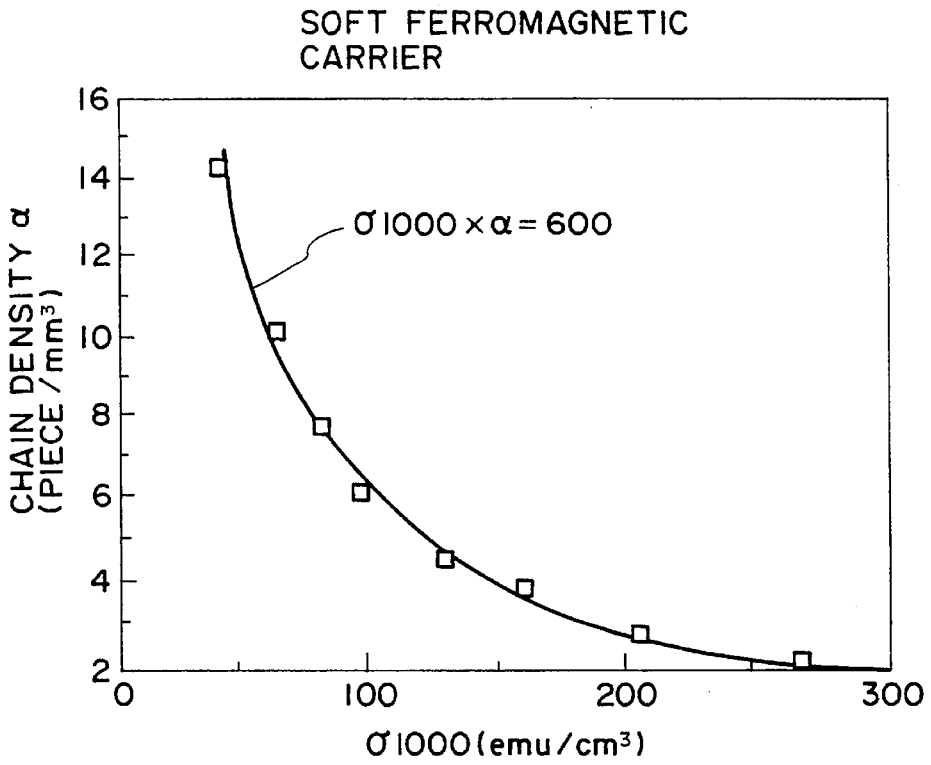
FIG. 8 is a graph showing a relationship between a magnetization and a density of magnetic brush chains when an external magnetic field is 1000 Gauss in the case where soft ferromagnetic carrier particles are used.

In this embodiment, the toner may contain coloring resin particles (including binder resin, coloring material, and/or additives, if desired) and colloidal silica fine particles. In this embodiment, the toner is negatively chargeable polyester resin having a volume average particle size of 8 μm As the magnetic particles usable with the present invention, there are iron with or without surface oxidation, nickel, cobalt, manganese, chrome, rare earth metal or other metals, or arroys thereof, or oxidized ferrite. The manufacturing method of the magnetic particles is not limited. The magnetic particles 82 have a weight average particle size of 20–100 μm, preferably 30–70 μm and have a resistance of not less than $10^7$ ohm.cm, preferably not less than $10^8$ ohm.cm. In this embodiment, soft ferromagnetic carrier (soft ferrite) exhibiting the magnetic property shown in FIG. 8 is used.

In this embodiment, a negatively chargeable toner is used, and the dark potential is −700 V, and the light potential is −200 V. The developing sleeve 23 is supplied with an alternating voltage having an alternating voltage component having a frequency of 2000 Hz and a peak-to-peak voltage Vpp of 2000 V and a DC component of −550 V. With this, reverse development is effected, that is, the contrast potential is 350 V, and the fog removing voltage is 150 V.

The outer diameter of the photosensitive drum 3 as the image bearing member is 80 mm, and the outer diameter of the developing sleeve 23 is 32 mm, and the gap between the developing sleeve 23 and the regulating blade 24 is 500 mm. The peripheral speed of the photosensitive drum 3 is 160 mm/sec, and the peripheral speed of the developing sleeve 23 is 280 mm/sec.

The volume average particle size is determined using 100 μm aperture in the following manner.

A coulter counter Model TA-II (available from Coulter Electronics Inc.) is used, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a first class sodium chloride chloride. Into 100 to 150 ml of the electrolytic solution, 0.1 of a surfactant, preferably an alkylbenzenesulfonic acid salt, is added as a dispersant, and 0.5 to 50 mg, of a sample is added thereto. The resultant dispersion of the same in the electrolytic liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 μu-aperture to obtain a volume-basis distribution. From the results of the distribution, volume average particle size is determined.

As for the measurement of the resistance of the magnetic particles, a sandwich type cell having a necessary electrode area of 4 $cm^2$ and an inter-electrode distance of 0.4 cm is used. One of the electrodes is pressed by Kgf, and a voltage E (V/cm) is applied. On the basis of the current flowing through the circuit, the resistance of the magnetic particles is determined.

As described hereinbefore, it is known that an increase in the density of the magnetic brush on the developing sleeve is effective to prevent the image roughness in the high-light and halftone density regions. When dot latent image is formed, the latent image is sharp as compared with analog latent image, but non-uniformity (roughness) tends to occur corresponding to the chains of the magnetic brush. Therefore, when the dot latent image is developed, higher density of magnetic brush is desired. As a method for changing the magnetic brush density on the developing sleeve, there is a method in which the magnetic property of the magnetic carrier is changed. More particularly, the magnitude of the magnetization of the magnetized carrier provided by the magnetic field of the developing magnetic pole, is reduced. This corresponds to a reduction in the magnetic permeability when the carrier is made of soft ferrite. FIG. 8 shows the magnetic brush density (constant leakage on the sleeve) on the developing sleeve when the magnetization per unit volume of the magnetic carrier ($\sigma d$ (emu/$cm^3$), where d is the magnitude of the magnetic field of the developing pole), is changed, in the magnetic field at the developing magnetic pole. As to d, it is considered to be approx. 1000 Gauss, and the following evaluations will be made on the basis of σ1000 as the magnetization. As will be apparent from FIG. 8, the density of the magnetic brush increases with the decrease of σ1000.

The relationship among the magnetic brush density changed through the method described above, the image quality of the output image (the image roughness in the high-light and halftone zones) and the carrier deposition, is evaluated on the basis of produced images provided under the conditions of 200 dpi in the main scan direction and 400 dpi in the sub-scan direction, using usual two component development. The results are shown in Table 1 below.

TABLE 1

| σ1000 (emu/cm$^3$) | Black density (fibers/mm) | Image roughness | Carrier deposition |
|---|---|---|---|
| 270 | 2.5 | ↑ Poor | No |
| 206 | 3 | \| | No |
| 150 | 4 | \| | No |
| 140 | 4.5 | \| | Fair |
| 94 | 6 | \| | Yes |
| 75 | 8 | \| | Yes |
| 68 | 10 | \| | Yes |
| 40 | 14 | ↓ Good | Yes |

When the magnetic brush density is increased, the roughness of the image is reduced. As will be understood from Table 1, with the decrease of σ1000 (magnetization per unit surface) the image quality is improved, that is, the roughness is decreased. However, on the other hand, by reducing σd, the force of confining the carrier on the sleeve at the developing position decreases with the result that the carrier particles are deposited on the non-image area and high-light zone, mainly. From Table 1, it will be understood that a small amount of carrier particles is deposited with σ1000 of 140 (emu/cm$^3$), and that a great amount of carriage deposition is produced when it is not more than 150 (emu/cm$^3$), The carrier deposition occurs when the magnetic force applied to the magnetic carrier is smaller than the electrostatic force, since then the carrier is attracted to the photosensitive drum at that time. The magnetic carrier receives the magnetic force vector Fb in the direction of attracting it toward the developing sleeve by the magnetic field produce by the magnet roller, and is also receives the electrostatic force vector Fe in the direction of attracting toward the photosensitive drum by the developing bias (such a peak voltage of $V_{pp}$ as attracting the carrier to the photosensitive drum plus fog removing voltage). The magnetic force vector Fb (dyn/one carrier) applied to one carrier particle is $$\text{Vector } Fb = -V(\text{vector } mV \times \text{vector } B) \ldots \text{CGS unit}$$

where carrier magnetization is m (emu/cm$^3$), V (cm$^3$) is a volume of one carrier particle, and B (Gauss) is a magnetic field provided by the magnet roller.

Figure 9:
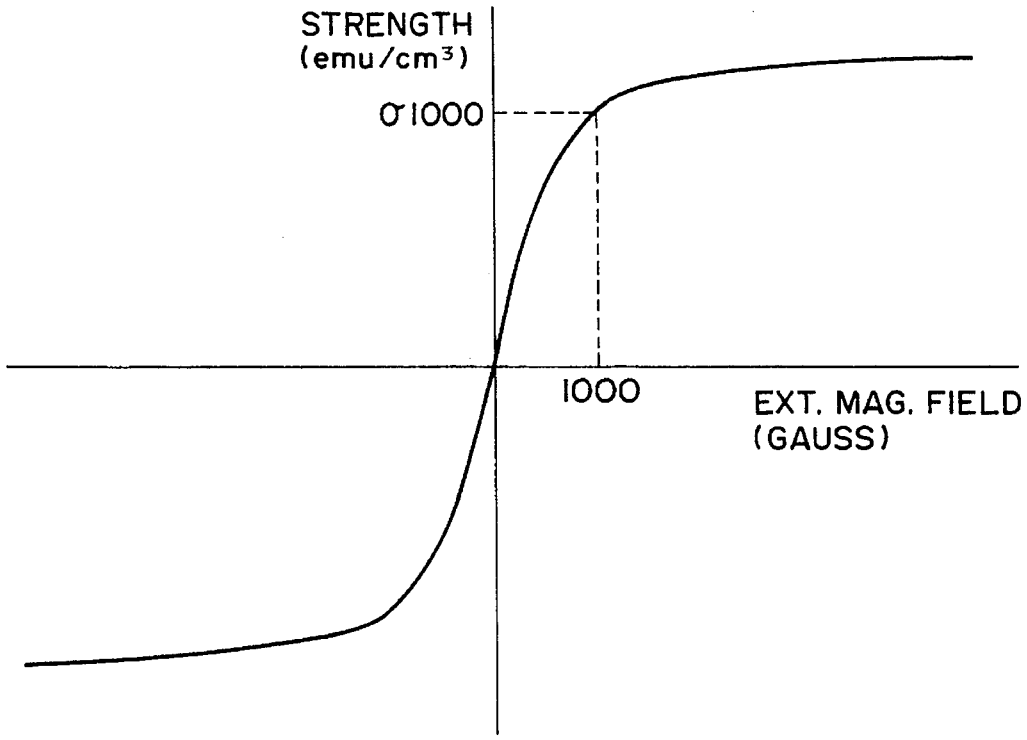
FIG. 9 is a graph of magnetic property of the soft ferromagnetic carrier particles.

The direction of the carrier magnetization is along the external magnetic field (the direction of magnetic lines of force), that is, vector m//vector B, and therefore, the magnetic force is small with the result of tendency of a occurrence of carrier deposition because the magnetization vector M is small in the same magnetic field, even if the charge amount of the carrier particles is the same.

when the soft ferrite carrier is used as described above, the intensity of the magnetization is saturated adjacent 1000 Gauss of The external magnetic field, as will be apparent from the graph which shows the relationship between the intensity of magnetization and the external magnetic field shown in FIG. 9. Therefore, when one magnetic carrier particle is in a magnetic field of about 1000 Gauss or larger, the magnetic force vector Fb can be considered as a force in a direction normal to the sleeve (vector Fr) and a parallel force (vector Fθ) The magnetic force applied in the normal direction per one carrier particle is $$\begin{aligned} \text{Vector } Fr \text{ (dyn/one carrier particle)} &= -d/dr\,(\text{vector mV} \cdot \text{vector } B) \\ &= -Vd/dr\,(|\text{vector } m|\,|\text{vector } B|) \\ &= -V/\text{vector } m|d/dr|\text{vector } B| \ldots CGS \text{ unit} \end{aligned}$$

where r is a distance in a radial direction (cm).

Thus, |vector m| can be taken to the front of the gradient. The force is proportional to the gradient of the absolute value of the intensity of the magnetic field in the direction normal to the sleeve surface. The force is directed toward the center of he developing roller.

The magnetic force in the tangential direction is as follows:

$$\begin{aligned} \text{Vector } F\theta \text{ (dyn/one carrier particle)} &= 1/rd/d\theta\,(\text{vector mV} \cdot \text{vector } B) \\ &= V/rd/d\theta\,(|\text{vector } m|\,|\text{vector } B|) \\ &= V/r|\text{vector } m|d/d\theta|\text{vector } B| \ldots CGS \text{ unit} \end{aligned}$$

where θ is positive in the developer conveying direction (rotational direction of the sleeve).

The force is proportional to the gradient of the absolute value of the intensity of the magnetic field in the tangential direction of the sleeve surface.

Therefore, when the vector Fθ is small as compared with vector Fr or vector Fe, using the carrier particles having the same charge amount, the carrier deposition starts in the nip where the carrier is contacted to the photosensitive drum when the developing sleeve and the photosensitive drum are moved or rotated, at $$|\text{vector Fe}| > |\text{vector Fe}|.$$

The NIP is determined as follows. A both sided tape is stacked on the photosensitive drum, and the developing sleeve is faced to the tape with 500 μm gap. The developing sleeve is rotated at 280 mm/sec for 3 sec while the photosensitive drum is at rest. Then, the developer is deposited on the tape, and the nip is determined on the basis of the developer deposited. When strength of the vector Fr is the same, and Fθ is equivalent to or stronger than the vector Fr and extends in the developer conveying direction (if the direction is the opposite, the developer stagnated in the front part of the developing zone) in the entirety of the nip (where the carrier is contacted to the drum) when the developing sleeve and the photosensitive drum are operated, carrier deposition can be avoided with the above described developing bias voltage, even if σ1000 of the carrier is low.

Accordingly, in this embodiment, in the nip of the developing zone where the photosensitive drum and the developing roller are closest, the absolute value of the intensity of the magnetic field increases in the tangential direction of the developing sleeve (developing feeding direction), that is, the magnetic force in the tangential direction in the rotational direction of the developing sleeve (the developer feeding direction) is increased while maintaining the magnetic force in the direction of attracting the magnetic carrier to the surface of the developing sleeve in the normal direction to the surface of the developing sleeve.

Figure 1:
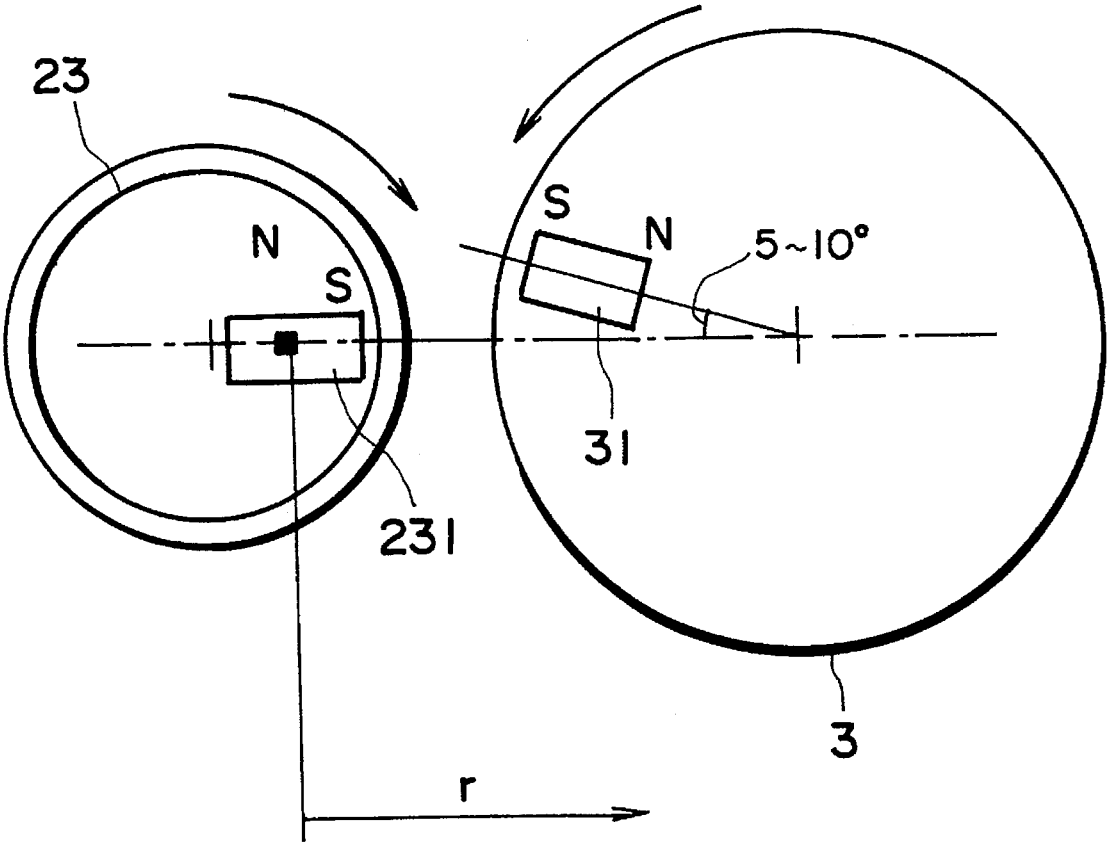
FIG. 1 is an illustration of a part of an image forming apparatus according to the present invention.

More particularly, as shown in FIG. 1, in the photosensitive drum 3, a magnet 31 of the same polarity at the developing pole is disposed at a fixed position which is 5–10 degrees upstream, in the rotational direction of the photosensitive drum, of the closest position where the main developing magnet 231 is disposed and where the developing sleeve 23 and the photosensitive drum 3 are closest (FIG. 1 is a schematic sectional view of the developing roller end the photosensitive drum).

Figure 10:
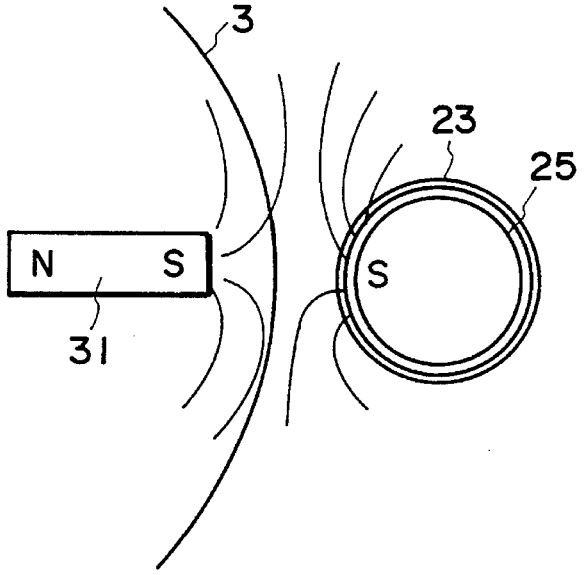
FIG. 10 illustrates a distribution of magnetic lines of force in the developing zone in the first embodiment.
Figure 11:
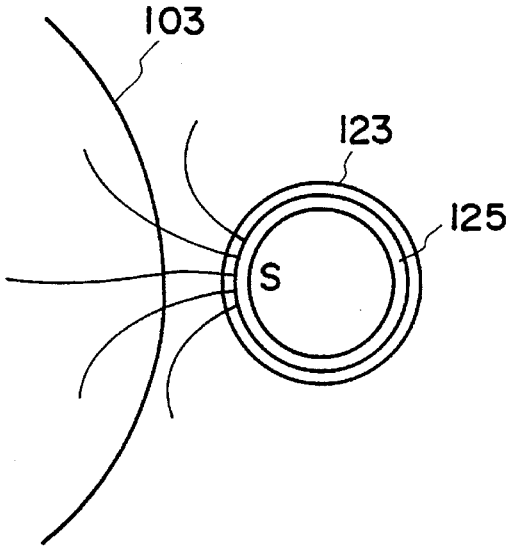
FIG. 11 shows a distribution of magnetic lines of force in the developing zone in an image forming apparatus, as compared with FIG. 10.

The distribution of the magnetic lines of force with this structure is as shown in FIG. 10. FIG. 11 shows a distribution of magnetic lines of force in a structure not using the present invention.

As will be understood from these Figures, the distribution of the magnetic lines of force is different between when a magnet is disposed in the photosensitive drum 3 and when it is not disposed in the position where the developing sleeve 23 and the photosensitive drum 3 are closest to each other. With the magnet 31 in the photosensitive drum 3, the magnetic lines of force are deformed, and when the developing sleeve and the photosensitive drum are operated, the area in which the carrier particles are contacted to the drum is narrower.

Figure 12:
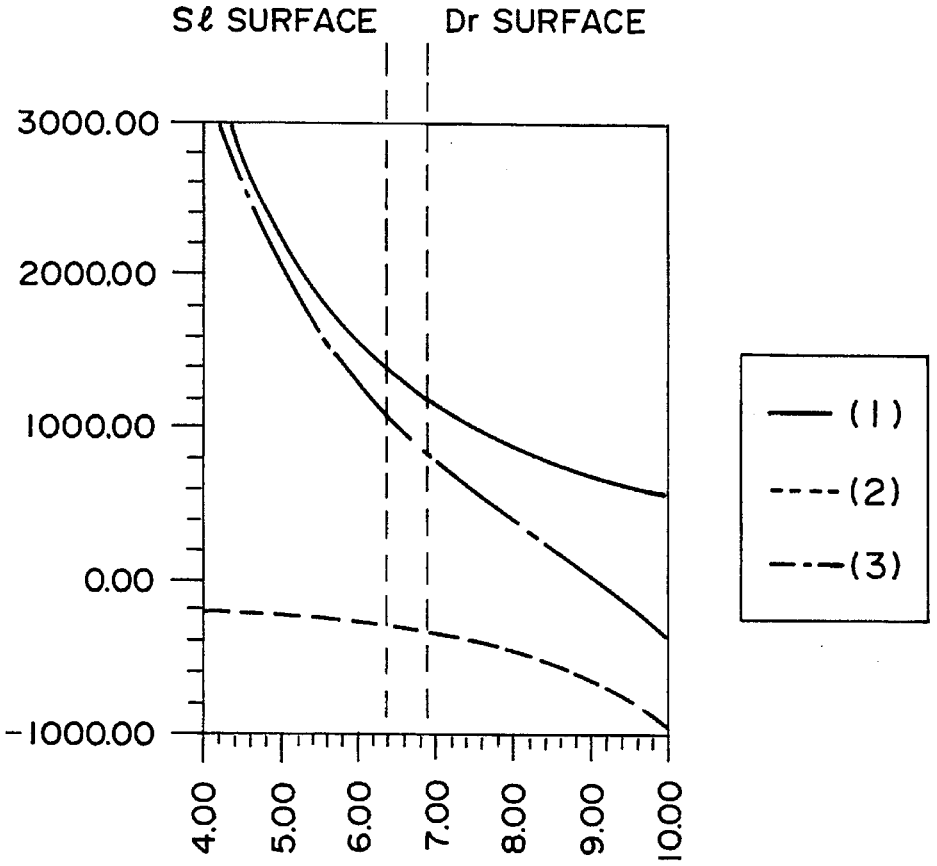
FIG. 12 is a graph of an intensity of magnetic field from a center of the magnet of a developing magnetic pole, in the first embodiment.

FIG. 12 shows the intensities of the magnetic fields extending from the center of the developing pole 231 on a line connecting the axis of the developing roller and the axis of the photosensitive drum, for the developing pole 231 alone, the magnet 31 alone in the photosensitive drum, and a combination of these magnets (curves (1), (2) and (3)). The intensity of the magnetic field is expressed as a vector B, and may be considered as a vector Br in the direction normal to the surface of the sleeve and a vector Bθ in the sleeve rotational direction. In the case of the magnetic field shown in FIG. 12, vector Bθ is 0, and therefore, the above-described analysis is permitted. With the developing pole alone, the intensity of the magnetic field on the developing sleeve surface is 1400 Gauss, and the magnet alone in the photosensitive drum, the intensity of the magnetic field on the photosensitive drum surface is −300 Gauss. The 0 Gauss point occurs at a position 2.2 mm away from the surface of the photosensitive drum toward the inside of the photosensitive drum. When the absolute value of the intensity of the magnetic field adjacent the photosensitive drum is 1000 Gauss or at least 700 Gauss, the carrier magnetization is saturated, and Fr is proportional to the gradient of the absolute value of the magnetic field in the direction normal to the sleeve surface. In order to make the absolute value of the magnetic field not less than 700 Gauss, a peak position of the magnetic field in the direction normal to the developing surface is disposed in the nip in this embodiment.

Figure 13:
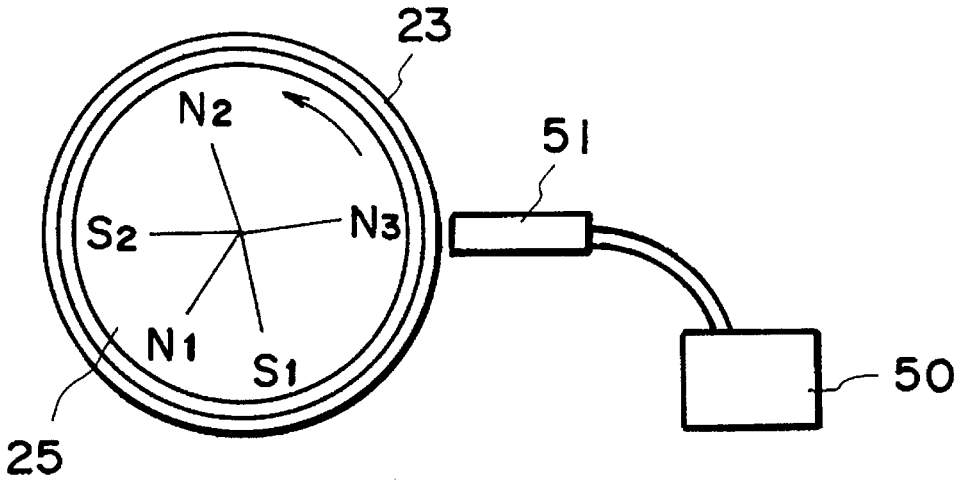
FIG. 13 illustrates a measuring method for Br.
Figure 14:
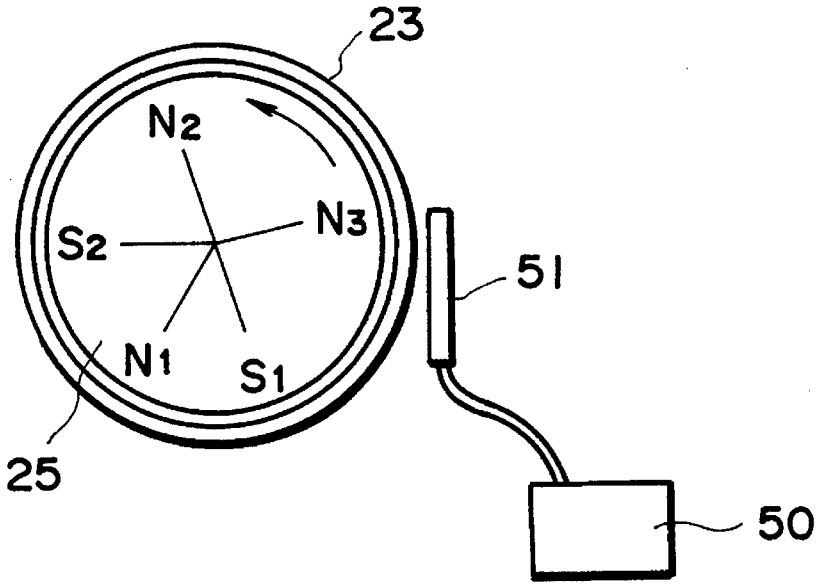
FIG. 14 illustrates a measuring method for Bθ.

FIGS. 13 and 14 show an example of a measuring method for the intensity of the magnetic fields Br and Bθ.

FIG. 13 illustrates a measuring method of the magnetic flux density Br in the normal direction on the surface of the developing sleeve 23, using a Gauss meter Model 640 available from Bell Laboratories. In FIG. 13, the developing sleeve 23 is fixed so as to take a horizontal position, and the magnet roller 25 is rotatably mounted in the developing sleeve. An axial probe 51 is horizontally fixed with a very small gap from the developing sleeve 23 and with the center of the developing sleeve 23 and the center of the probe 51 substantially in a common horizontal plane. It is connected with the Gauss meter 50 to determine the magnetic flux density on the surface of the developing sleeve. The developing sleeve 22 and the magnet roller 23 are substantially concentric so that the gap between the developing sleeve 22 and the magnet roller 23 is uniformly equal along the circumference. Therefore, by rotating the magnet roller, the magnetic flux density Br in the normal direction on the developing sleeve 22 can be measured for all the circumferential positions.

FIG. 14 illustrates a measuring method for the magnetic flux density Bθ in the tangential direction on the surface of the developing sleeve 23. Similarly to FIG. 13, the developing sleeve 23 is fixed at a horizontal position, and the magnet roller 25 is rotatably supported in the developing sleeve 23. An axis probe 51 is vertically fixed with a very small gap from the developing sleeve 23 and with the center of the developing sleeve 23 and the measuring center of the probe 51 substantially in a common horizontal plane. It is connected with the Gauss meter 50 to measure the magnetic flux density in the tangential direction on the developing sleeve surface. Similar to FIG. 13, by rotating the magnet roller 23 in the direction indicated by an arrow, the magnetic flux density Bθ in the tangential direction on the developing sleeve surface can be measured at all circumferential positions.

Using $Br$ and $B\theta$ thusdetermined $$|B| = \sqrt{(Br^2 + B\theta^2}$$

is determined.

The gradient in the direction perpendicular to the sleeve surface is proportional to |vector Fr|. Similarly, the gradient in the direction tangential to the sleeve surface is proportional to |vector Fθ|.

Figure 15:
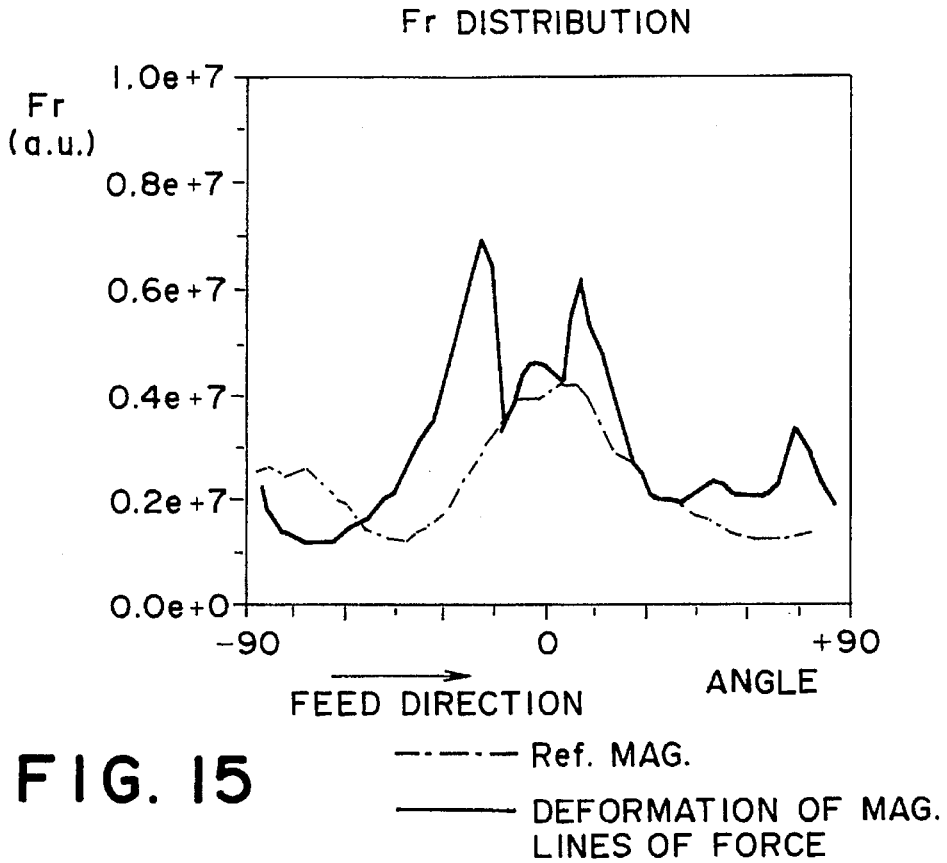
FIG. 15 shows a distribution of Fr.
Figure 16:
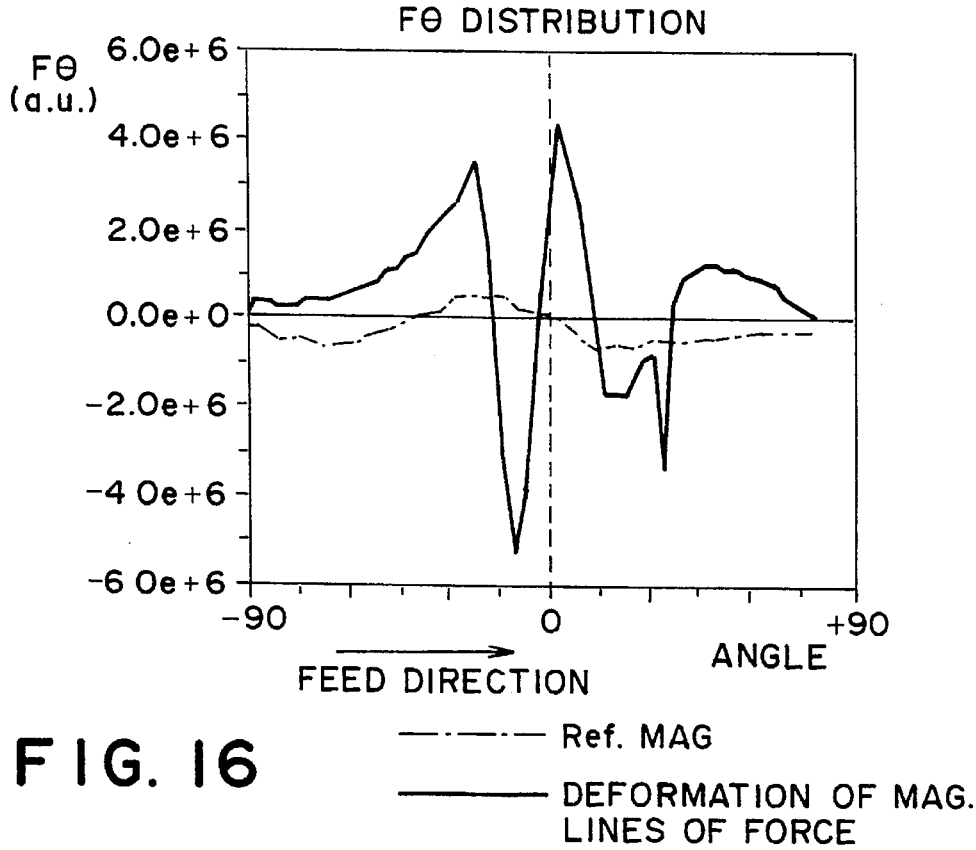
FIG. 16 is a distribution of Fθ.

FIG. 15 shows the gradient (proportional to the vector Fr) of the absolute value of the intensity of the magnetic field in the direction normal to the sleeve surface with the above-described arrangement. FIG. 16 shows the gradient of the absolute value of the magnetic field in the developer feeding direction that is the sleeve rotating direction (proportional to vector Fθ). In both of FIGS. 15 and 16, the abscissa represents an angle of the developing sleeve. The rotational direction is indicated by an arrow, and the 0 degree position corresponds to the position where the developing sleeve and the photosensitive drum are closest. The ordinate represents the gradient of the absolute value Of the intensity of the magnetic field in the direction perpendicular to the developing sleeve surface (positive in the direction toward the developing sleeve) and in the rotational direction of the developing sleeve (positive in the developer feeding direction, and negative in the opposite direction). An arbitrary unit (a. u.) is used. The size of the nip is approx. ±1.5 degrees with the center at 0 degree. In this region, if the strength of the vector Fr is the same and if the vector Fθ having a strength equivalent to that of the vector Fr or at least 50% of the strength of |vector Fr| is applied in the developer feeding direction, then carrier deposition can be avoided even with the above-described developing bias voltage, even if σ1000 of the carrier is lowered.

In FIG. 16, the strength of the vector Fθ decreases in the developer feeding tangential direction of the developing sleeve in the first half (the magnetic brush is not contacted to the photosensitive drum) of the developing zone; and it decreases in the same direction (the force is applied in the developer feeding direction) in the second half portion. With this structure the magnetic brush conveyed into the developing zone by the rotation of the developing sleeve jumps toward the downstream of the developing zone along the deformed magnetic lines of force, while maintaining the configuration. As a result, the magnetic brush density is increased in a dynamic state in the developing zone, thus avoiding image roughness. In addition, the toner is in the form of powder cloud so that toner in the bottom layer of the magnetic brush can be used for development, thus increasing the image density.

In this embodiment, the carrier or has σ1000 of 60 (emu/cm$^3$) and a volume average particle size of 30 μm. To the developing sleeve, an alternating bias voltage is applied from a voltage source not shown, and in this embodiment Vpp is 2000 V, frequency is 2000 Hz. Generally, in a two component developing method, the developing efficiency is increased by application of an alternating bias voltage, and the image quality is increased. In this embodiment, the non-uniformity attributable to the magnetic brush is reduced by application of the alternating bias voltage. However, the application of the developing bias tends to promote the carrier deposition. However, according to this embodiment, the carrier deposition can be reduced even if the magnetic carrier has σ1000 of 150 (emu/cm$^3$) or lower with the above-described bias voltage, so that the image density can be increased and the roughness of the high-light image can be reduced while the developing magnetic brush density is increased.

Embodiment 2

This embodiment is different from the first embodiment in the intensities and arrangement of the magnetic poles N2 and S2 of the magnet as the magnetic field generating means in the developing apparatus and in that no magnet is provided in the photosensitive drum.

Figure 17:
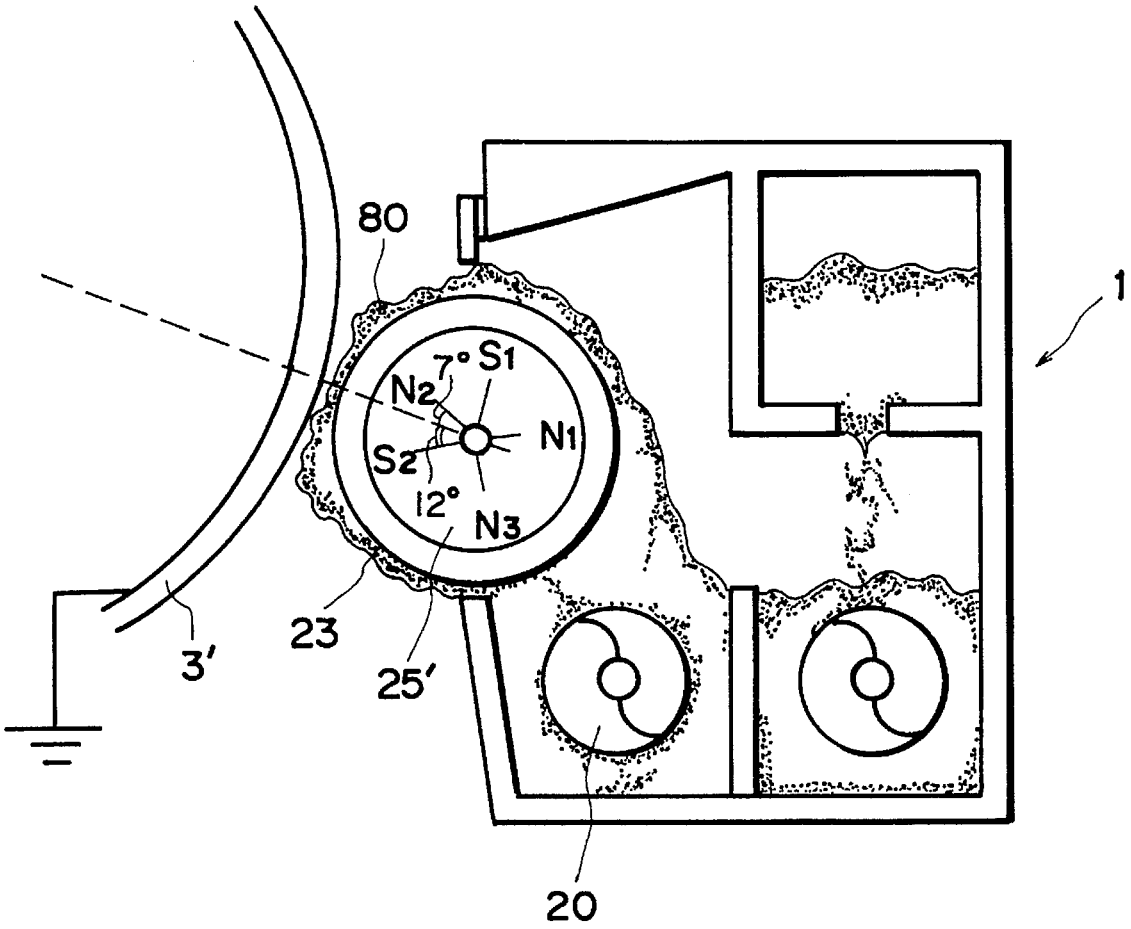
FIG. 17 illustrates a structure of a developing apparatus according to a second embodiment of the present invention.

As shown in FIG. 17, the developing device 1' of this embodiment is the same as the developing roller of the first embodiment in the developer feeding path, developer stirring or the like. However, the magnetic pole N2 is disposed at a position 7 degrees upstream, with respect to the rotational direction of the developing sleeve 23, of the closest position between the developing sleeve 23 and the photosensitive drum 3'; and pole N2 is disposed 12 degrees downstream, with respect to the same direction, of the closest position. The peak level of the intensity of the magnetic field of the magnetic pole N2 in the direction normal to the surface of the developing sleeve is 700 Gauss, and the peak level of the intensity of the magnetic field of the pole S2 in the direction normal to the developing sleeve surface is 150 Gauss.

The nip in which the two component developer is contacted to the photosensitive drum, extends from the closest position between the developing sleeve and the photosensitive drum 3' to 7 the degrees downstream position in the rotational direction of the developing sleeve 23. In order to make the absolute value of the intensity of the magnetic field at least 700 Gauss, the peak level of the magnetic field intensity in the direction perpendicular to the surface of the developing sleeve is contained in the nip also in this embodiment. By doing so, the intensity of the magnetic field increases in the feeding direction of the developer in the contact nip.

With this structure, in the entirety of the nip area where the two component developer is in contact with the photosensitive drum, the increase ratio of the absolute value of the strength of the magnetic field in the circumferential direction of the developing sleeve (developer feeding direction) can be made positive, thus suppressing carrier deposition.

Embodiment 3

Figure 18:
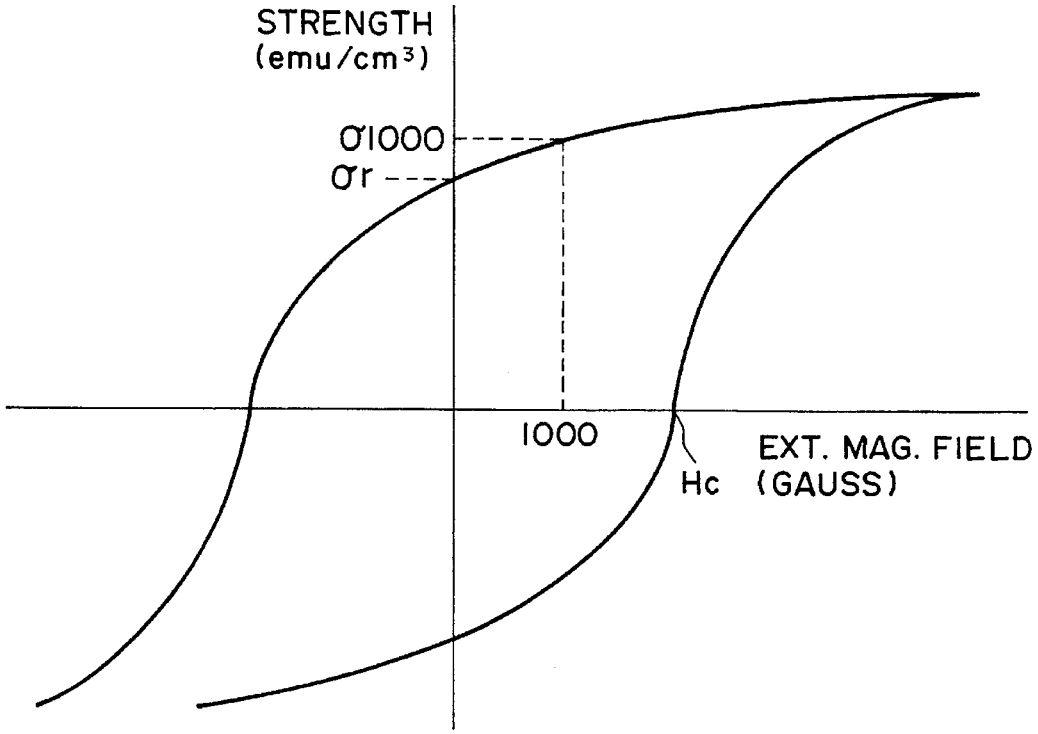
FIG. 18 is a graph of magnetic property of hard ferromagnetic carrier particles in a third embodiment of the present invention.

In the first embodiment use is made of Soft ferrite carrier exhibiting the magnetic property shown in FIG. 9 as the carrier for the two component developer, but in this embodiment, use is made of a hard ferrite carrier exhibiting the hysteresis property as shown in FIG. 18, and the hard ferrite carrier has a coercive force Hc and a remnant magnetization Pr.

Since the hard ferromagnetic carrier has the remnant magnetization Pr, it has a certain degree of magnetization even if the external magnetic field is reduced (away from the developing sleeve). Therefore, the attracting force between carrier particles and the attracting force to the developing electrode is strong, and therefore, the hard ferrite carrier is advantageous over the soft ferrite carrier in terms of carrier deposition.

Figure 19:
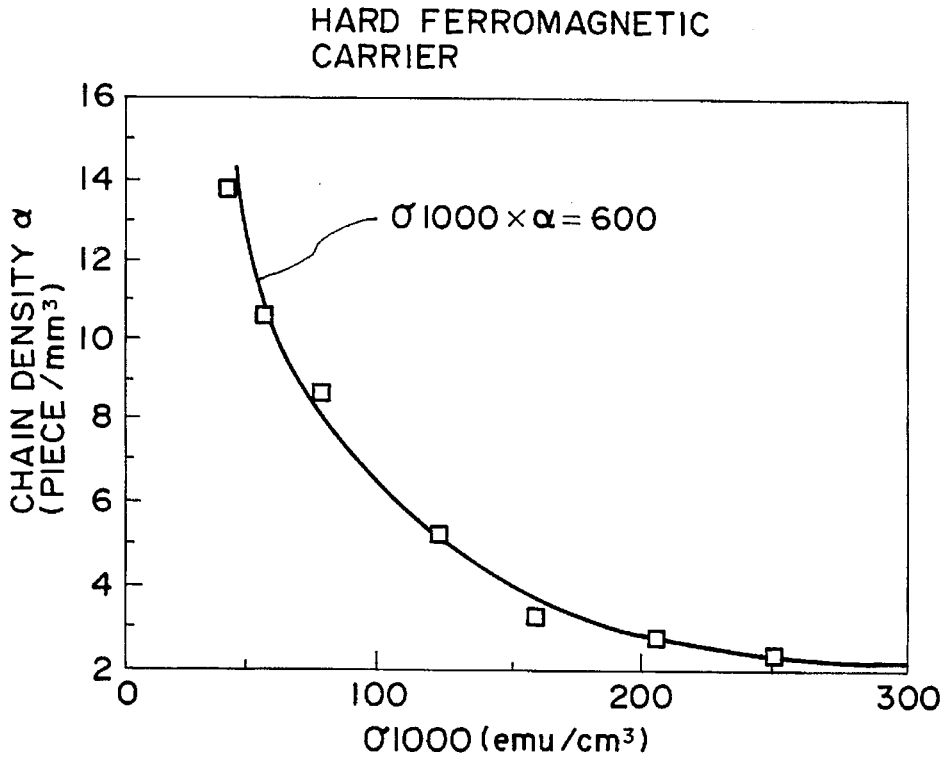
FIG. 19 shows a relationship between a magnetization and a magnetic brush chain density when the external magnetic field is 1000 Gauss in the case of a hard ferromagnetic carrier.

The latent image forming method and the structure of the apparatus are the same as in Embodiment 1, only the carrier of the developer is replaced. Using such a hard ferrite carrier, an investigation has been made with respect to the relationship between the magnetization and the density of the magnetic brush in the case of a magnetic force of 1000 Gauss. The carrier used in the developer has a remnant magnetization Hc of approx. 2000 (Oe) for all carriers. But the magnetization σ1000 (emu/cm$^3$) and the remnant magnetization Pr in 1000 Gauss are different. As will be understood from FIG. 19, the relationship between σ1000 and the density is such that the magnetic brush density increases with a decrease of σ1000, similarly to the case of the soft ferrite carrier. Table 2 below shows the relationship among the magnetic brush density thus changed, the image quality of the output image (roughness in the high-light and halftone zone) of the output image and the carrier deposition, under the conditions of 2000 dpi in the main scanning direction and 400 dpi in the sub-scan direction, using the two component non-contact developing method, similarly to Embodiment 1.

TABLE 2

| σ1000 (emu/cm$^3$) | Black density (fibers/mm) | Image roughness | Carrier deposition |
|---|---|---|---|
| 270 | 2.5 | ↑ Poor | No |
| 206 | 3 | \| | No |
| 160 | 4 | \| | No |
| 128 | 4.5 | \| | No |
| 94 | 6 | \| | Fair |
| 75 | 8 | \| | Yes |
| 68 | 10 | \| | Yes |
| 40 | 14 | ↓ Good | Yes |

The results shown are substantially the same as in Embodiment 1, the roughness decreases with an increase in the brush density, but the carrier deposition occurs when σ1000 is lower than 100 (emu/cm$^3$).

With this structure, even if the magnetic carrier is of hard ferromagnetic material, the image roughness in the high-light zone is removed, and the image density can be increased while maintaining the magnetic brush density, even when the magnetization per unit area in the magnetic field of 1000 Gauss is not more than 150 (emu/cm$^3$). In addition carrier deposition can be suppressed.

Embodiment 4

A superimposing developing process has recently been proposed in which toner images are directly superimposed on the photosensitive member to produce a color image. This embodiment uses such an superimposing developing process.

Figure 20:
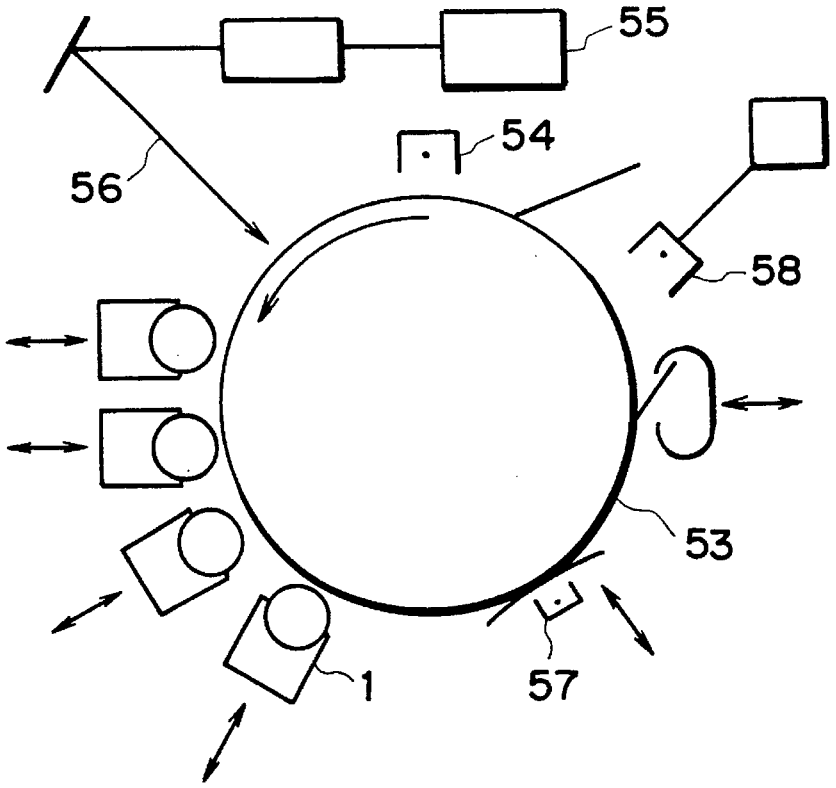
FIG. 20 is a sectional view of an image forming apparatus according to a fourth embodiment of the present invention.
Figure 22:
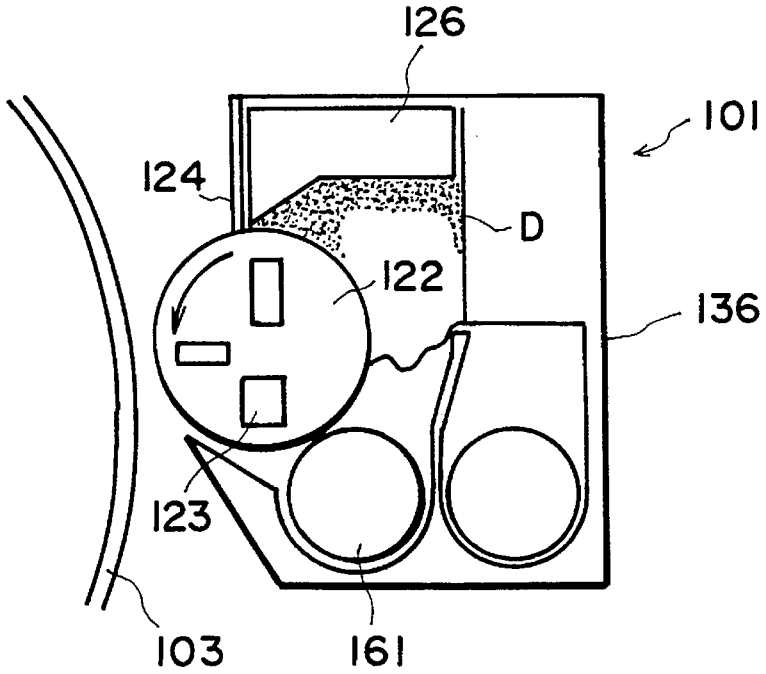
FIG. 22 is a sectional view of a developing apparatus.

Referring first to FIG. 20, a description will be made as to a conventional image forming apparatus using the superimposing developing process. The photosensitive drum 53 is uniformly charged by a changer 54 as a first step. Subsequently, a latent image is formed by exposure means 55 on the photosensitive drum 53, and the latent image is developed by depositing the toner only to the portion of the photosensitive member exposed to the laser beam 56, through reverse-development. This process is repeated for three or four colors (magenta, cyan, yellow (black)), so that superimposed color toner images are formed on the photosensitive drum 53. All of the toner images are transferred onto a sheet of paper by transfer means 57, and the residual charge on the photosensitive drum 3 is removed by a pre-exposure lamp 58. Thereafter, the sheet is passed through an unshown image fixing device, so that a fixed color image is produced on the sheet.

In this structure, the developing device 1 shown in FIG. 7 (Embodiment 1) is used, and the magnetization per unit volume of the carrier is not more than 150 (emu/$cm^3$) or lower in 1000 Gauss in order to increase the magnetic brush density. The latent image forming method, the apparatus structure and the developer are the same as in Embodiment 1.

With this structure, using a magnetic carrier having small σ1000, the image density can be increased with suppressed carrier deposition and without highlight zone roughness, while maintaining the magnetic brush density adjacent the magnetic pole.

Embodiment 5

Figure 21:
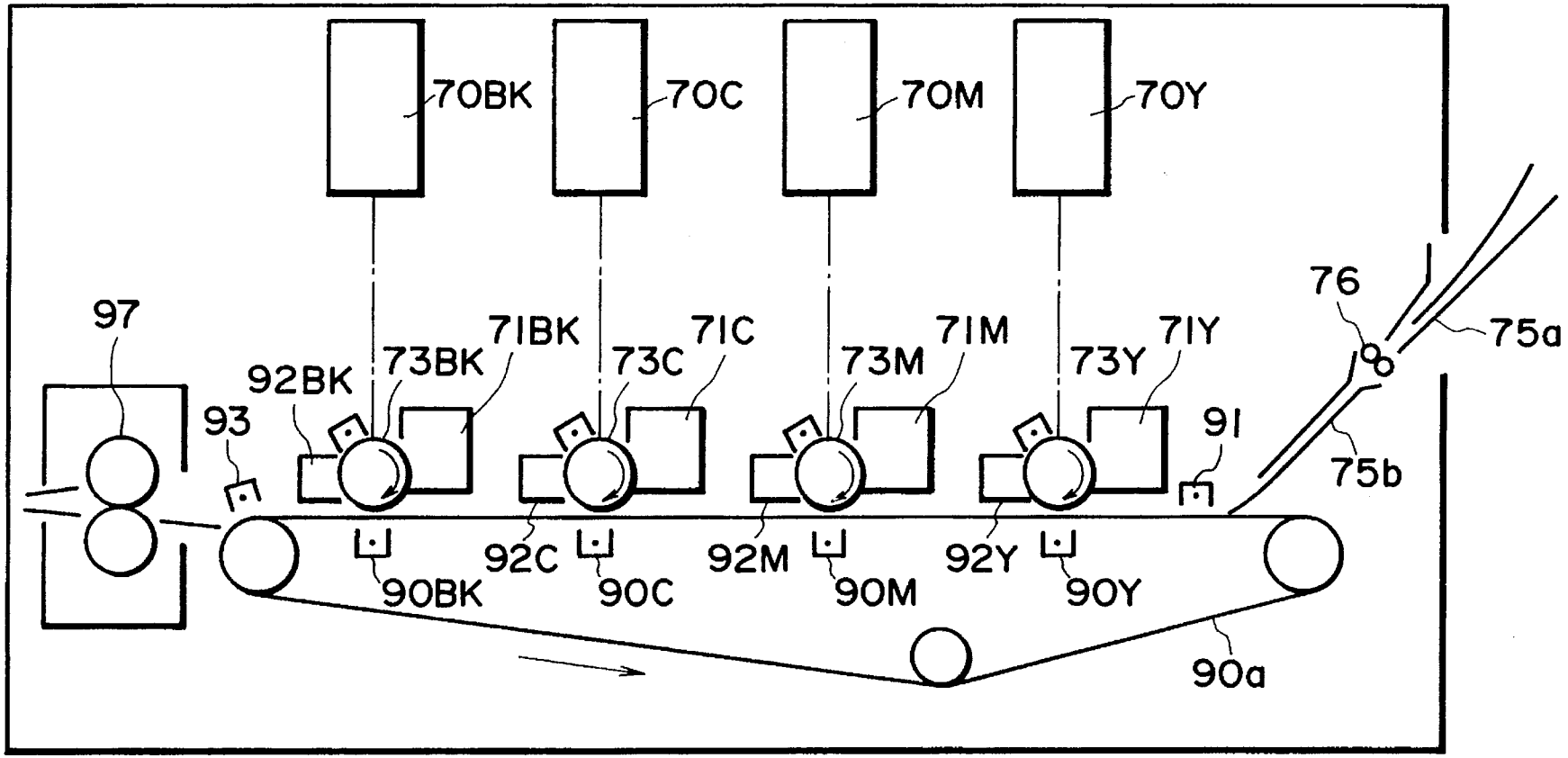
FIG. 21 is a sectional view of an image forming apparatus according to a fifth embodiment of the present invention.

Referring to FIG. 21, a fifth embodiment of an image forming apparatus will be described.

In this embodiment, the image forming apparatus is in the form of a full-color laser beam printer. However, unlike the foregoing embodiments, it comprises image bearing members arranged for respective colors, more particularly a photosensitive drum 73Y for yellow, 73M for magenta, 74C for cyan and 73BK for black. Around the respective drums, laser beam scanners 70Y, 70M, 70C and 70BK, developing devices 71Y, 71M, 71C and 71BK, transfer discharger 90Y, 90M, 90C and 90BK, and cleaning devices 92Y, 92M, 92C and 92BK.

The transfer material is fed along the sheet guide 75*a* and the sheet guide 75*b* by feeding roller 76, and is subjected to corona discharging by attraction charger 91, and is securely attracted to the feeding belt 90*a*.

Thereafter, images formed on the respective photosensitive drums are transferred by transfer dischargers 90Y, 90M, 90C and 90BK, respectively. Then, the sheet is separated from the feeding belt 90*a* by discharger 93, and the image is fixed thereon by a fixing device 97, thus producing a full-color print.

In this embodiment, the latent image forming method, the apparatus structure and the developer are the same as in the first embodiment. In order to increase the magnetic brush density, the magnetic carrier exhibits a magnetization per unit volume of 150 (emu/$cm^3$) or lower in the magnetic field of 1000 Gauss.

With the above-described structure, using the magnetic carrier having small σ1000, the high-light roughness can be removed, and the image density can be increased with suppressed carrier deposition, while maintaining the density of the magnetic brush adjacent the developing magnetic pole.

While the invention has been described with reference to the structures disclosed herein, it is not confined to the details set forth and this application is intended to cover such modifications or changes as may come within the purposes of the improvements or the scope of the following claims.

What is claimed is:

1. A developing method, comprising the steps of:

forming a magnetic field between an image bearing member bearing an electrostatic image and a developer carrying member carrying a developer comprising toner particles and carrier particles; and contacting chains of carrier particles formed on the developer carrying member to the image bearing member;

wherein an increasing rate of an absolute value of an intensity of the magnetic field in a movement direction of the developer carrying member is positive over an entire portion of the developer carrying member where the carrier is contacted to the image bearing member.

2. A method according to claim 1, wherein said magnetic field forming step includes providing a peak of the intensity of the magnetic field in a direction normal to the developer carrying member in a region where the carrier particles are contacted to the image bearing member.

3. A method according to claim 1, wherein said magnetic field forming step includes forming a magnetic field in which the increasing rate is not less than 50% of an increasing rate of the absolute value in a direction normal to the developer carrying member, in a region where the carrier particles are contacted to the image bearing member.

4. A method according to claim 1, wherein said magnetic field forming step includes providing magnetic field generating means in the image bearing member.

5. A method according to claim 4, wherein said magnetic field forming step includes providing a developing magnetic pole in the developer carrying member, facing the image bearing member, the magnetic field generating means having a magnetic pole having the same polarity as a polarity of the developing magnetic pole.

6. A method according to claim 5, wherein said magnetic field forming step includes disposing the magnetic pole of the magnetic field generating means upstream of the developing magnetic pole with respect to the movement direction.

7. A method according to claim 1, wherein the carrier particles have a magnetization of not more than 150 emu/$cm^3$ in a magnetic field of 1000 Gauss.

8. A method according to claim 1, further comprising the step of forming an alternating electric field between the image bearing member and the developer carrying member.

* * * * *

UNITED STATES PATENT AND TRADEMARK OFFICE

CERTIFICATE OF CORRECTION

PATENT NO. : 5,576,812 Page 1 of 5

DATED : November 19, 1996

INVENTOR(S) : MASARU HIBINO, ET AL.

It is certified that error appears in the above-indentified patent and that said Letters Patent is hereby corrected as shown below:

IN THE DRAWINGS:

SHEET 11, FIGURE 16

"-4 0e +6" should read -- -4.0e+6--.
"-6 0e+6" should read -- -6.0e+6--.

COLUMN 1:

Line 10, "through" should read --through an--.
Line 39, "8" should read --8 μm--.
Line 51, "fore," should read --fore, a--.

COLUMN 2:

Line 11, "become" should read --becomes--.
Line 19, "region" should read --region is released--.
Line 49, "a graph" should read --graphs--; and "of on/off of a laser source," should read --of on/off operation of a laser source,".

UNITED STATES PATENT AND TRADEMARK OFFICE

CERTIFICATE OF CORRECTION

PATENT NO. : 5,576,812

DATED : November 19, 1996

INVENTOR(S) : MASARU HIBINO, ET AL.

It is certified that error appears in the above-indentified patent and that said Letters Patent is hereby corrected as shown below:

COLUMN 3:

Line 47, "beta" should read --beam--.

COLUMN 4:

Line 26, "which" should read --which is--.

COLUMN 5:

Line 18, "A" should read --An--.
Line 28, "reset" should read --resets--.
Line 65, "402," should read --402--.

COLUMN 6:

Line 3, "405," should read --405--.
Line 53, "case" should read --case,--.
Line 57, "system" should read --system,--.
Line 61, "of#" should read --of--.

UNITED STATES PATENT AND TRADEMARK OFFICE

CERTIFICATE OF CORRECTION

PATENT NO. : 5,576,812

DATED : November 19, 1996

INVENTOR(S) : MASARU HIBINO, ET AL.

It is certified that error appears in the above-indentified patent and that said Letters Patent is hereby corrected as shown below:

COLUMN 7:

Line 9, "there" should read --there- --.
Line 14, "tile" should read --the--.
Line 18, "therefor" should read --therefore--.

COLUMN 8:

Line 21, "coulter" should read --Coulter--.
Line 55, delete "of".

COLUMN 9:

Line 40, delete "then".
Line 43, "produce" should read --produced--.
Line 44, "is" should read --it--.
Line 45, "attracting" should read --attracting it--.
Line 46, "a" should read --as--.
Line 47, "carrier" should read --carrier particle--.
Line 50, "Vector Fb=-V(vector mVxvector B)" should read --Vector Fb=-∇(vector mV x vector B)--.
Line 59, "of" should read --of a--.
Line 63, "when" should read --When--.
Line 65, "The" should read --the--.

UNITED STATES PATENT AND TRADEMARK OFFICE

CERTIFICATE OF CORRECTION

PATENT NO. : 5,576,812 Page 4 of 5

DATED : November 19, 1996

INVENTOR(S) : MASARU HIBINO, ET AL.

It is certified that error appears in the above-indentified patent and that said Letters Patent is hereby corrected as shown below:

COLUMN 10:

Line 5, "(vector Fθ)" should read --(vector Fθ).--.
Line 10, "-V/vector m| d/dr| vectorB| " should read -- -V| vector m| d/dr| vectorB| --.
Line 17, "he" should read --the--.
Line 40, "NIP" should read --nip--; and "both sided" should read --both-sided--.

COLUMN 11:

Line 6, "end" should read --and--.
Line 35, "and" should read --and with--.

COLUMN 12:

Line 19, "thusdetermined" should read --thus determined--.
Line 22, "$|B| = \sqrt{(Br^2+B\theta^2}$" should read --$|B| = \sqrt{(Br^2+B\theta^2)}$--.
Line 40, "Of" should read --of--.

UNITED STATES PATENT AND TRADEMARK OFFICE

CERTIFICATE OF CORRECTION

PATENT NO. : 5,576,812 Page 5 of 5

DATED : November 19, 1996

INVENTOR(S) : MASARU HIBINO, ET AL.

It is certified that error appears in the above-indentified patent and that said Letters Patent is hereby corrected as shown below:

COLUMN 13:

Line 3, delete "or".
Line 13, delete "the". (2nd Occurrence)
Line 15, delete "the". (1st Occurrence)
Line 45, "7 the" should read --the 7--.
Line 61, "embodiment" should read --embodiment,--; and "Soft" should read --soft--.

COLUMN 14:

Line 24, delete "of the output image".
Line 44, delete "the".
Line 57, "an" should read --a--.

COLUMN 15:

Line 13, "The" should read --In the--.
Line 29, "Around the respective drums," should read -- Positioned --. around the respective drums are--.

Signed and Sealed this

Twenty-seventh Day of May, 1997

Bruce Lehman

*Attest:*

BRUCE LEHMAN

*Attesting Officer*

*Commissioner of Patents and Trademarks*